US007374047B2

(12) United States Patent
Bryson et al.

(10) Patent No.: US 7,374,047 B2
(45) Date of Patent: May 20, 2008

(54) ADJUSTABLE SHIPPER DISPLAY SYSTEM

(75) Inventors: Michelle Marie Bryson, Palatine, IL (US); Neil Darin, Grayslake, IL (US); Jennifer Allison Enciso, Palatine, IL (US); Frank Pizzitola, Streamwood, IL (US)

(73) Assignee: Kraft Foods Holdings, Inc., Northfield, IL (US)

( * ) Notice: Subject to any disclaimer, the term of this patent is extended or adjusted under 35 U.S.C. 154(b) by 342 days.

(21) Appl. No.: 10/887,658

(22) Filed: Jul. 9, 2004

(65) Prior Publication Data

US 2005/0067321 A1 Mar. 31, 2005

Related U.S. Application Data

(60) Provisional application No. 60/488,716, filed on Jul. 18, 2003.

(51) Int. Cl.
*B65D 5/50* (2006.01)

(52) U.S. Cl. ..... 206/743; 108/107; 312/351

(58) Field of Classification Search ..... 206/740, 206/743, 745, 756; 211/134, 135, 186, 187, 211/153; 312/351; 108/107, 109, 193; 229/178, 229/122, 164, 165, 172

See application file for complete search history.

(56) References Cited

U.S. PATENT DOCUMENTS

| | | | | |
|---|---|---|---|---|
| 3,100,460 | A * | 8/1963 | McElroy | 108/109 |
| 4,417,655 | A | 11/1983 | Forbes, Jr. | |
| 4,646,921 | A | 3/1987 | Canter | |
| 5,035,323 | A | 7/1991 | Daniels et al. | |
| 5,076,177 | A | 12/1991 | Chien | |
| 5,392,902 | A * | 2/1995 | Vlastakis | 211/135 |
| 5,464,103 | A * | 11/1995 | O'Brien | 211/133.3 |
| 5,826,728 | A | 10/1998 | Sheffer | |
| 6,435,351 | B1 | 8/2002 | Gibb | |
| 6,505,094 | B2 | 1/2003 | Pape et al. | |

* cited by examiner

*Primary Examiner*—Shian T. Luong
(74) *Attorney, Agent, or Firm*—Fitch, Even, Tabin & Flannery

(57) ABSTRACT

An adjustable shipper display system includes a master shell having side walls with mounting positions. A plurality of tray-like shelves are supported at each end at the mounting positions. Fillers are insertable along the shelves to divide the shelves into compartment spaces and to provide dunnage where required. With minimum modification the shipper can be prepared for displaying articles to the consumer without requiring removal or other adjustment of the articles within the shipper.

30 Claims, 31 Drawing Sheets

ADJUSTABLE SHIPPER DISPLAY SYSTEM

This application claims the benefit of U.S. Provisional Application No. 60/488,716, filed Jul. 18, 2003, which is hereby incorporated herein by reference in its entirety.

BACKGROUND OF THE INVENTION

1. Field of the Invention

The present invention relates to containers used for packaging articles for shipment as well as for displaying those articles at a point of sale. More particularly, the present invention is directed to systems for shipping and displaying which are adjustable in their configuration, which are readily erected at a point of sale and which are inexpensive so as to be disposable, when no longer needed.

2. Description of the Related Art

Packaging arrangements are known to have a dual function of both containing or holding articles during shipment and to function as a display for those articles, typically at a retail store, convenience store, drug store, club store or mass merchandiser such as regional and national grocery stores. Such arrangements provide a material handling advantage in that they eliminate the need at the retail outlet to remove the individual articles and to place those articles individually on shelves, racks or other store fixtures, so that the articles are available to the consumer. When shipping and display arrangements are used, it is only necessary at the retail store to open the shipping container and, with minor adjustments, put the modified shipping container in a location accessible to the consumer. Oftentimes, stores are arranged in aisles with a special area being reserved at the end of each aisle for standardized product displays. For example, wire racks are provided as end extensions of opposing aisles, on which product displays are carried.

Arrangements for packing, shipping and displaying articles are sometimes utilized by an organization which produces or otherwise handles a wide variety of products having many different shapes and forms. For example, larger manufacturers of consumer food products may need to package, ship and display articles in glass and plastic jars and bottles of different sizes and shapes, bags of fragile food products, such as potato chips and tortilla chips, tubs of various food products, such as cottage cheese and dips and packages of meal or snack kits containing a variety of components. A mass merchandiser is under continuous pressure to ship on short notice special orders to stores or other customers who require an assortment of articles, oftentimes arranged in a palletized load. Such special purpose assortments can arise from the need of the customer to display seasonal promotions, for product roll outs of complementary food articles and to present a family of food articles to a consumer, such as different sized packages of the same food product. In order to meet increasingly stringent time demands, a mass merchandiser must be able to readily package and ship special orders upon receipt of the orders. Increasingly, orders are sent and received in electronic form, processed by programmable computers which operate at very fast speeds, such that orders are often received and shipped on the same day.

A commercially successful shipper display arrangement should be flexible in its configuration, that is, be adjustable so as to accommodate a wide variety of different articles. In order to provide substantial material handling advantages, the same shipper arrangements should be readily adaptable for displaying the articles being shipped. Consumers are becoming increasingly conscious of aesthetic values and it is important that shipper arrangements be converted to display functions without requiring mutilation of the packaging materials. Furthermore, commercially successful shipper display arrangements should be of such low cost as to permit their disposal when no longer required.

SUMMARY OF THE INVENTION

It is an object of the present invention to provide systems of shipper display packaging which are flexible, i.e., adjustable in their configuration so as to accommodate a wide variety of articles.

Another object of the present invention is to provide such shipper display systems utilizing a master shell formed from a single blank of material that is cut and scored to produce a construction suitable for manual or automated loading, for sealing by the shipper, and for subsequent conversion into a display unit at the point of use. Furthermore, it is an object of the present invention to provide shipper display systems having cooperating components which are also formed from a single blank of material that is cut and scored to produce the desired features.

A further object of the present invention is to provide such shipper and display systems which can be accumulated in commercially significant numbers for shipment in a sturdy and durable manner on a pallet and which can be readily adapted at the point of sale for display without need for disturbing or removing the articles from the basic shipping materials.

A further object of the present invention is to provide shipper display systems in which, in the display mode, a consumer is afforded a full view and access of the articles for sale.

In one aspect, these and other objects of the present invention are attained in a shipper display system utilizing a master shell of corrugated paperboard material having a rectangular tray shape with a back wall and four side walls. Interior surfaces of opposed side walls have a plurality of mounting positions for receiving shelves spanning the width of the master shell so as to engage the shelf side walls at desired mounting positions. In one preferred embodiment, the mounting positions are formed as a series of openings on the master shell side walls. Mounting clips are inserted within the openings and include inwardly extending tab portions for engaging and supporting ends of the shelves.

In other aspects, the present invention provides flexible configuration by providing shelves of different constructions. In general, the shelves are preferably formed from single integral pieces of foldable materials, such as corrugated board, paperboard, or plastic film which are scored and folded for erection to provide the desired shape and function. For example, shelves are provided having a rectangular five sided tray configuration with an open top and a forwardly facing front wall or lip. In other forms, the front wall of the tray style shelf is omitted to allow a consumer to slide an article off the shelf, without requiring the article to be lifted. In a further embodiment, tray-style shelves are provided in a double tier configuration, comprising a unitary construction in which one tray style shelf is positioned atop another.

Preferably, the shelves mounted within the master shell are continuous and undivided. Nonetheless, it is desirable to accommodate multiple articles arranged on a single shelf in side-by-side fashion. In a commercial environment in which a wide variety of different packages is encountered, it becomes necessary from time to time to divide the space of a particular shelf and/or to fill voids between products with dunnage articles. The present invention, in one aspect, provides flexibility in this regard with a variety of fillers preferably formed from a single integral blank of flexible material such as paperboard or plastic film, or molded Styrofoam. Most preferably, the fillers are erected from corrugated paperboard materials folded to take on the form of a hollow rectangular tube. The fillers are inserted or slid along a shelf to acquire their desired position. Preferably, the fillers are sized in height in the manner corresponding to the spacing of the mounting positions of the master shell. In this manner, shelf heights of uniform predetermined values allow for the prefabrication of fillers, such that a quantity of prefabricated fillers may be readily available at the time of packaging without requiring special construction.

As mentioned, it is generally preferred that the shelves be formed in a tray style so as to be continuous between the side walls of the master shell. Shelf clips or other mounting devices installed in the side walls of the master shells provide support at the opposed ends of the shelves. When formed from conventional paperboard material, the shelves take on the role of rigid load bearing beams supporting the weight of products placed on the shelves. At times, the shelf materials are required to be thin or flexible such that additional load bearing support for the shelves is required. It is generally preferred, in these instances that the back wall of the master shell be provided with a series of horizontal slots corresponding to the mounting positions of the master shell side walls. The shelves may be constructed so as to have rearwardly extending tabs which interengage slots in the master shell back wall. If desired, the slots and rearwardly facing tabs can be dimensioned so as to extend across substantially the entire width of the master shell.

With adjustable shipper display systems according to principles of the present invention, the interior volume of a master shell can be divided or partitioned in a number of ways so as to provide a wide variety of differently sized product compartments.

DETAILED DESCRIPTION OF THE PREFERRED EMBODIMENTS

Figure 1:
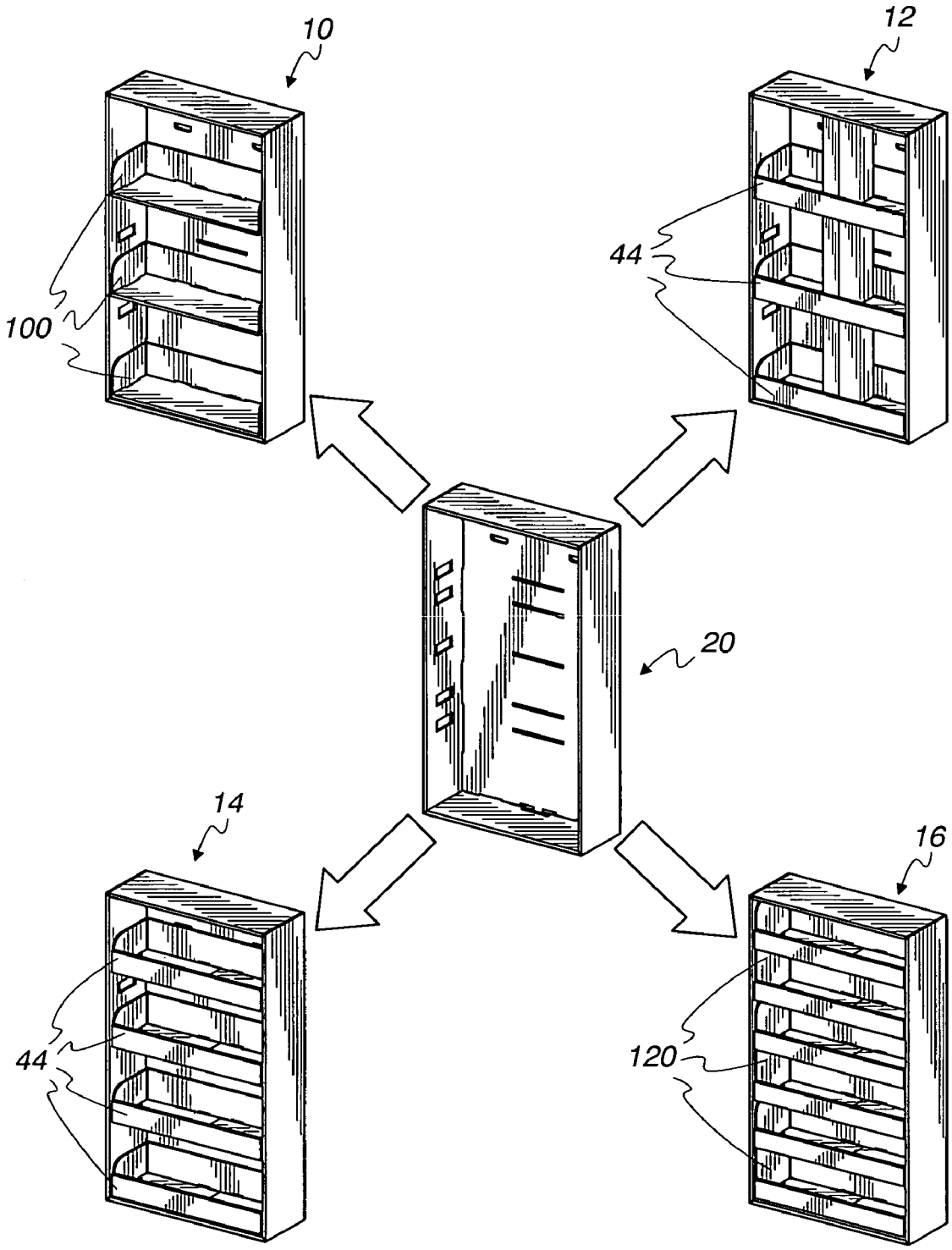
FIG. 1 is a diagrammatic perspective view of adjustable shipper display systems according to principles of the present invention.

Referring now to the drawings, FIG. 1 is a diagrammatic perspective view of adjustable shipper display systems according to principles of the present invention. The various shipper display systems 10, 12, 14 and 16 are built up from the same master package unit or master shell 20. Preferably, the master shell 20 and the various components for the adjustable shipper display systems according to principles of the present invention are each made of foldable material such as corrugated board, paperboard, and plastic film which is scored and folded for erection to provide the desired shape and function.

The adjustable shipper display systems according to principles of the present invention have found immediate commercial acceptance with a worldwide manufacturer of a wide variety of food articles leaving a large number of different article packaging types. For example, food articles such as potato chips, crackers and other friable food articles are packaged in flexible airtight bags to preserve freshness. The bags are however susceptible to crushing and suitable precautionary measures must be taken during shipping and display of these food articles to prevent breakage. Other food articles such as mayonnaise and salad dressing are contained in glass or plastic jars and bottles and have their own handling requirements to prevent breakage. Other articles such as meal kits or lunch kits have an assortment of different food products contained in a common outer package, oftentimes in the form of a paperboard box. The food articles vary not only in the nature of their fragility, but also in package rigidity and overall package size.

Large manufacturers of different food articles and mass merchandisers are subjected to increasingly severe time constraints to meet customer shipping demands. For example, food stores and other customers often place special orders for an assortment of different food articles, with the size of the overall order being such that the food articles are conveniently shipped in palletized form. With improvements in programmable computers and electronic communications, orders are often received with the expectation that shipment will be performed within a day or two and perhaps even on the same day. Adjustable shipper display systems according to principles of the present invention provide the flexibility, i.e., adjustability to readily accommodate a wide variety of different articles, differing in shape, fragility and weight. A master shell 20 shown in FIG. 1 provides the basis for various adjustable shipper display systems such as those indicated at 10, 12, 14 and 16 in FIG. 1. The shipper display systems according to principles of the present invention provide a dual function of safely containing articles during shipment, and upon arrival, as a display for the contained articles without requiring mutilation of the packaging materials, or removal or other reorganization of the articles within the shipping system. As will be seen herein, the master shell 20 is readily formed by scoring and folding a single integral blank of foldable material, such as corrugated board. Similarly, the remaining components of the adjustable shipper display systems according to principles of the present invention are also formed from respective low-cost blanks of corrugated board or other foldable material.

Figure 2:
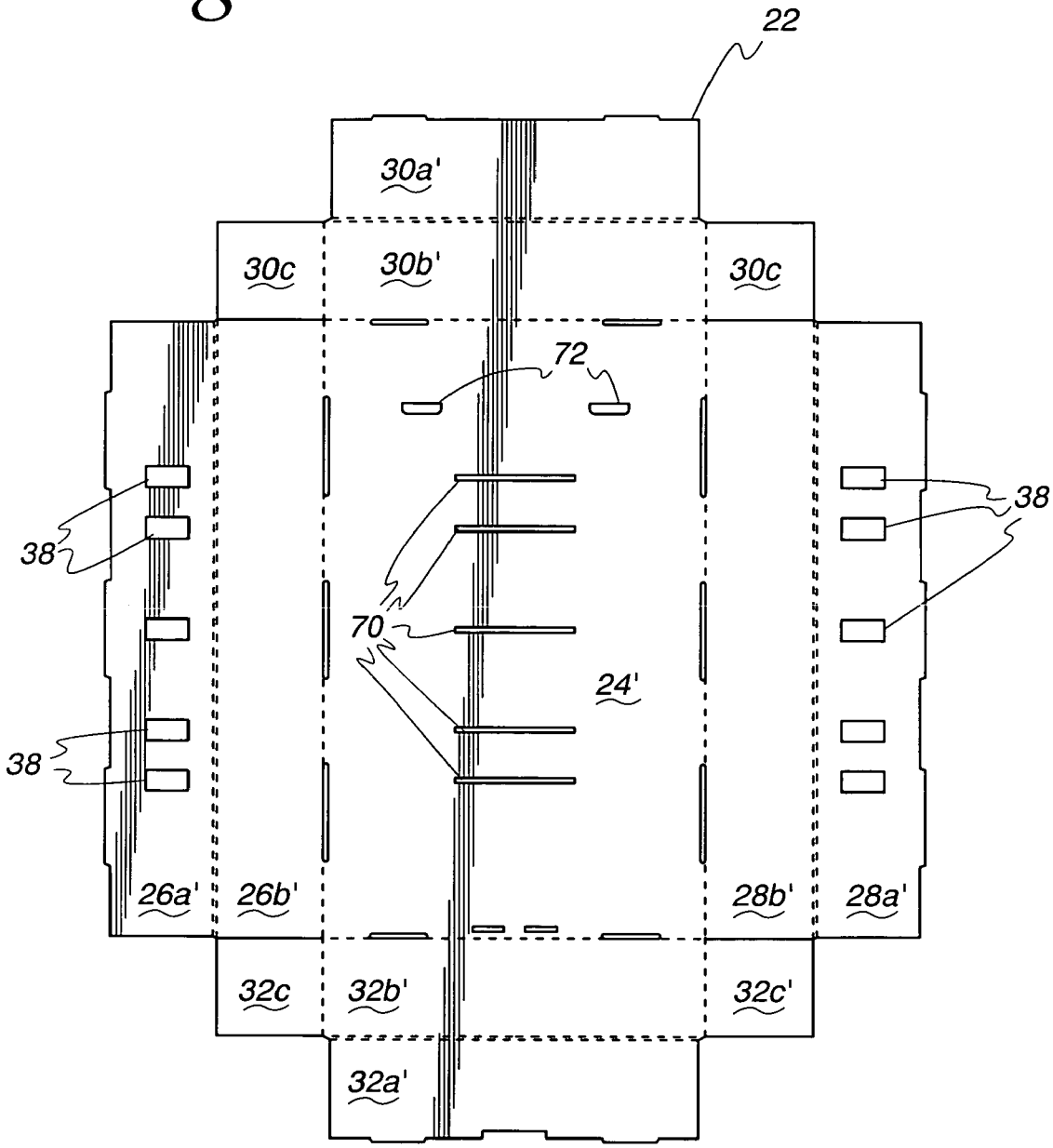
FIG. 2 is a plan view of a blank for the master shell.
Figure 3:
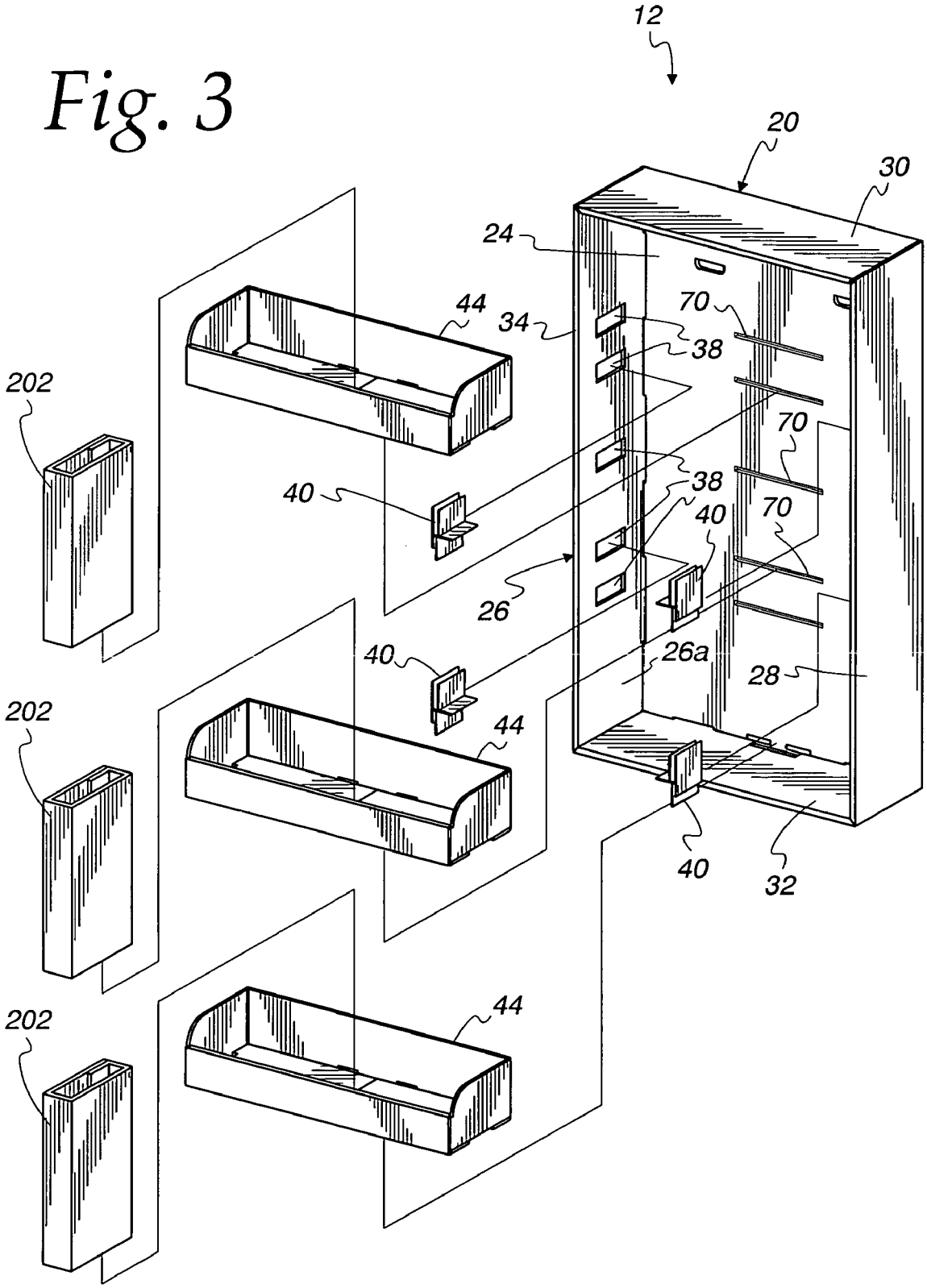
FIG. 3 is an exploded perspective view of one embodiment of a shipper display system according to principles of the present invention.
Figure 4:
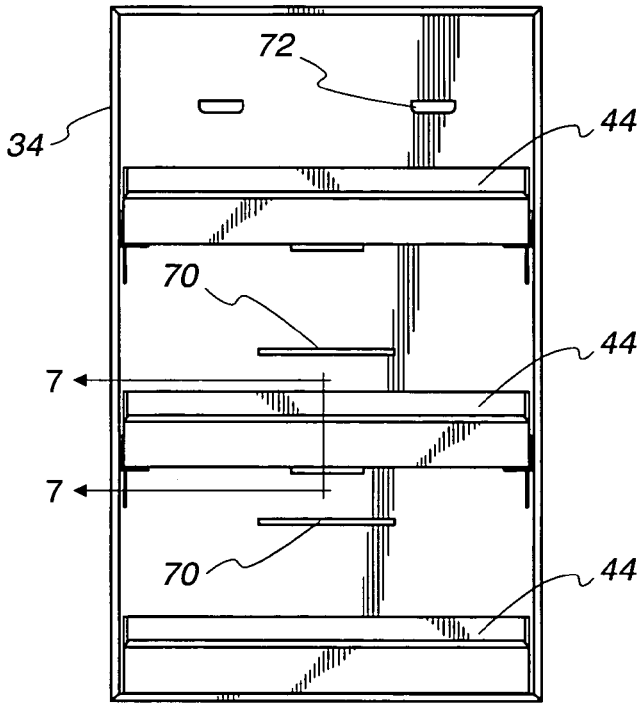
FIG. 4 is a front elevational view thereof.
Figure 5:
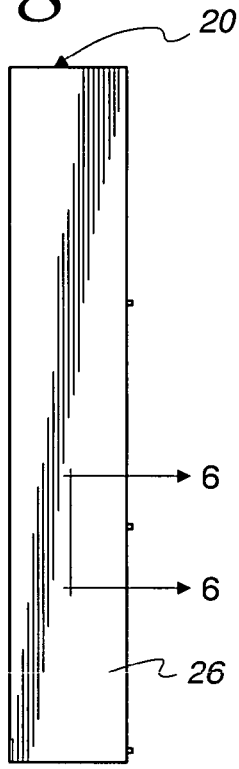
FIG. 5 is a side elevation view thereof.
Figure 6:
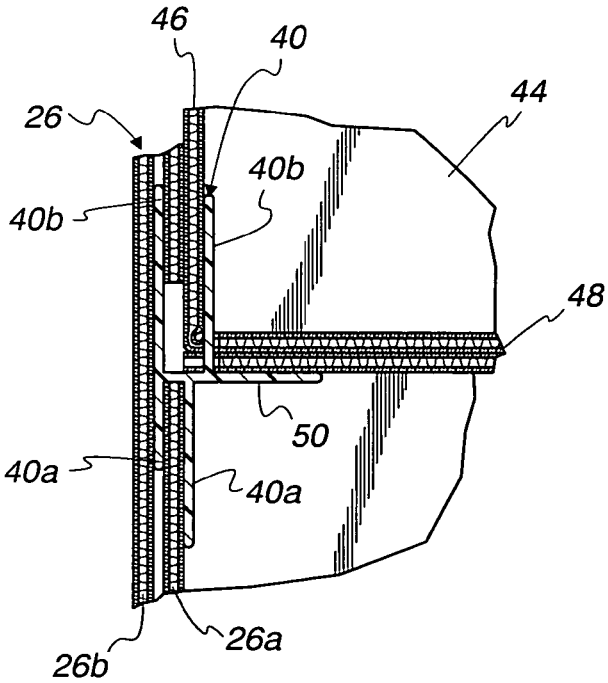
FIG. 6 is a cross-sectional view taken along the line 6-6 of FIG. 5.

Referring again to FIG. 1, master shell 20 is formed from the corrugated blank 22 shown in FIG. 2. The master shell 20 is also shown in FIGS. 3-7. Referring to FIG. 3, master shell 20 includes a rear wall 24, side walls 26, 28, a top wall 30 and a bottom wall 32 which extend from rear wall 24. In its form, master shell 20 generally resembles a tray of rectangular configuration having a continuous series of side walls. Referring to FIG. 6, side wall 26 has a double wall construction with inner and outer overlying walls **26*a*, 26*b* joined together at a bight portion 34 on the forward edge of master shell 20 (see FIG. 3). The opposed side wall 28** has an identical mirror-image construction.

Figure 28:
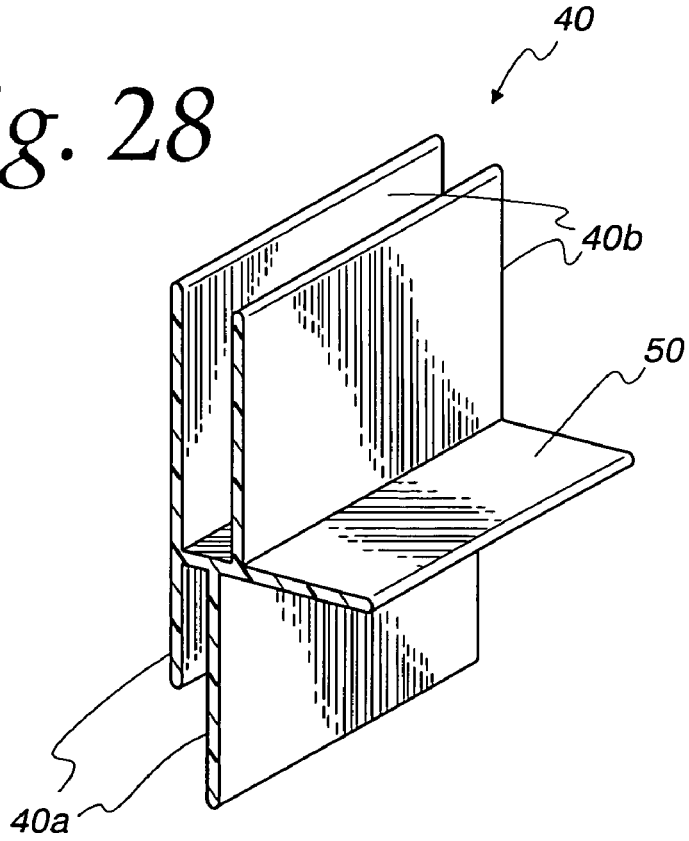
FIG. 28 is an enlarged side view of the mounting clip.

As can be seen for example in FIG. 3, inner wall **26*a* has a series of slots 38 arranged in a vertical series of mounting positions. The slots 38 are preferably provided in numbers equal to or greater than the number of shelves to be accommodated, in order to provide adjustability for the positions of the shelves within master shell 20. Due to the double wall construction, the slots 38 are backed by the outer wall 26*b*. As indicated in FIGS. 3-6, co-material clips 40 made of preferably rigid or semirigid plastic are inserted in openings 38 for interlocking engagement with side wall 26 and especially the inner wall 26*a* thereof. The clips 40 comprise shelf mounts for supporting ends of the shells received in master shell 20. Referring to FIG. 3, three bin-style shelves 44 are provided for mounting within master shell 20 for at a number of different mounting positions provided by openings 38 and clips 40. As can be seen in FIGS. 6 and 28, the clips 40 include a pair of lower clip walls 40*a* for receiving inner wall 26*a* and a pair of upper clip walls 40*b* for receiving inner wall 26*a* and a side wall 46 of shelf 44. As can be seen in FIG. 6, the inner clip wall 40*b* extends through an aperture formed in the double layer bottom wall 48 of shelf 44. Clip 40 further includes a tab 50 which underlies the double layer bottom wall 48 of shelf 44**.

Referring again to FIG. 2, blank 22 includes rear wall portion 24', outer side wall portions **26*b*', 28*b*', inner side wall portions 26*a*', 28*a*', top wall portions 30*a*', 30*b*' and floor wall portions 32*a*', 32*b*'. Blank 22 also includes side flaps 30*c* and 32*c* at the top and bottom of the master shell. As can be seen in FIG. 2, the inner walls, those arranged at the outer periphery of blank 22 have outwardly extending tab portions received in slots formed at the outer periphery of rear wall portion 24'. In addition, there are other slots 70 formed in rear wall portion 24' for supporting the shelves, as will be seen herein. Slots 72 are formed in rear wall portion 24' to allow hanging support for the master shell as will be described herein with reference to FIGS. 17 and 18**.

Referring again to FIG. 3, adjustable shipper display system 12 includes three bin-style or closed front shelves 44.

Figure 7:
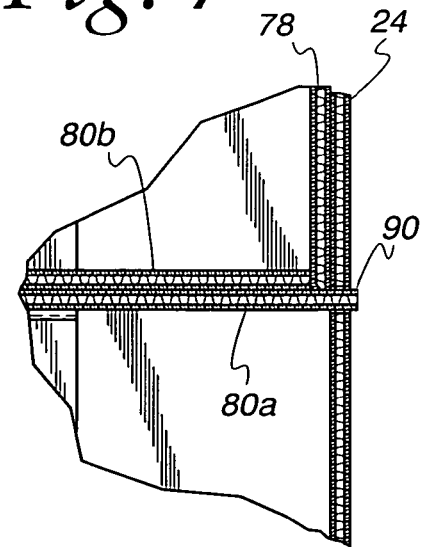
FIG. 7 is a cross-sectional view taken along the line 7-7 of FIG. 4.
Figure 8:
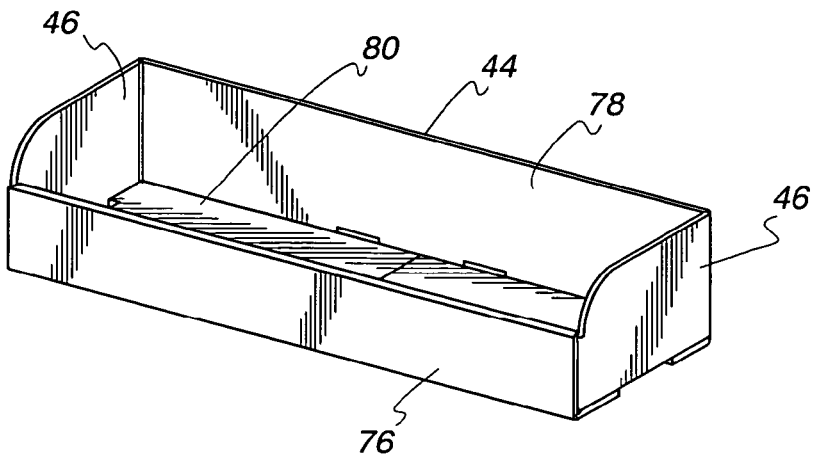
FIG. 8 is a perspective view of a bin-style shelf.
Figure 9:
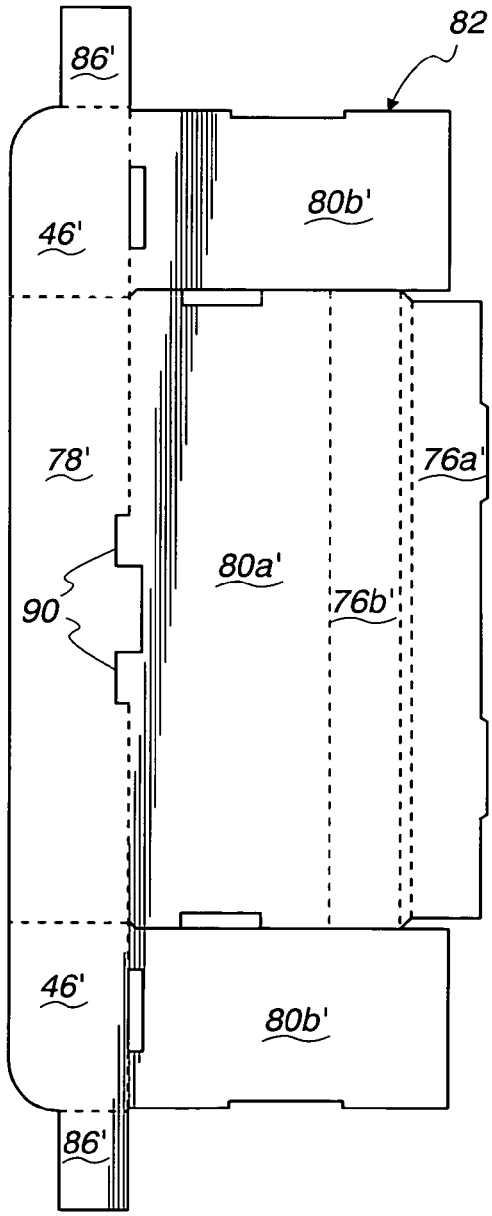
FIG. 9 is a plan view of a blank therefor.

Referring to FIG. 8, shelf 44 includes end walls 46, front and rear walls 76, 78 and bottom wall 80. FIG. 9 shows the blank 82 from which shelf 44 is fabricated. Preferably, blank 82 is made of foldable sheet material such as corrugated board, paperboard or plastic film, for example. Centrally located in blank 82 is a bottom floor portion 80*a*' joined at one side to rear wall portion 78' and to outer front wall portion 76*b*'. Front wall portion is of double layer construction and includes inner front wall portion 76*a*'. Side wall portions 46' are located at either end of rear wall portion 78'. Bottom wall half portions 80*b*' are attached to the end wall portions 46' and when folded overlay floor portion 80*a*'. Manufacturing tab portions 86' are attached to each end wall portion 46' and provide interlocking engagement with the overlying front wall portions. The joinder of rear wall portion 78' to floor portion 80*a*' includes score lines shown dotted and cut lines shown solid. Included in the cut portion is a pair of rearwardly extending tabs 90 which protrude beyond the shelf when the shelf is fully erected. The tabs 90 engage the slots 70 formed in rear wall 24 of the master shell. Thus, support is provided for the shelves intermediate the end walls to provide greater support for the weight carried on the shelf. Referring to FIG. 7, the tabs 90 extend from the lower floor portion 80*a* and interengage rear wall 24, as shown. The bin-style shelves 44 are used in the adjustable shipper display systems 12 and 14 as shown in FIG. 1.

Figure 10:
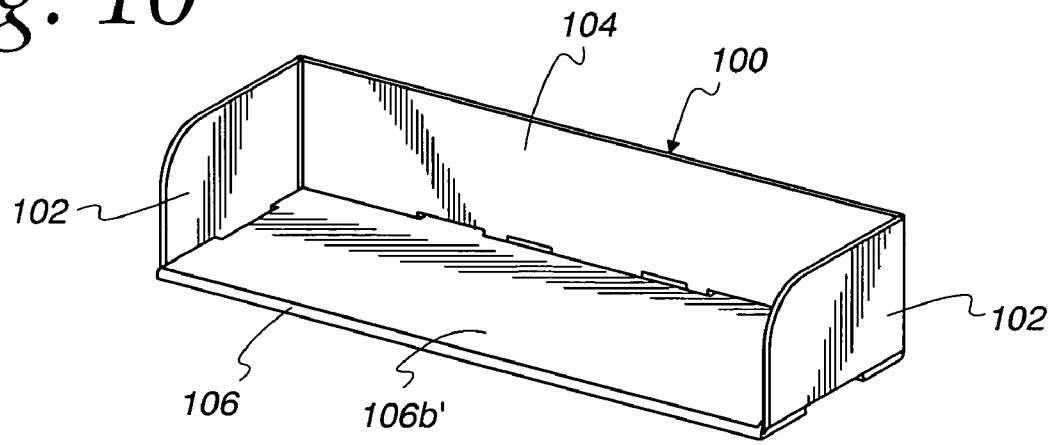
FIG. 10 is a perspective view of an open front shelf.
Figure 11:
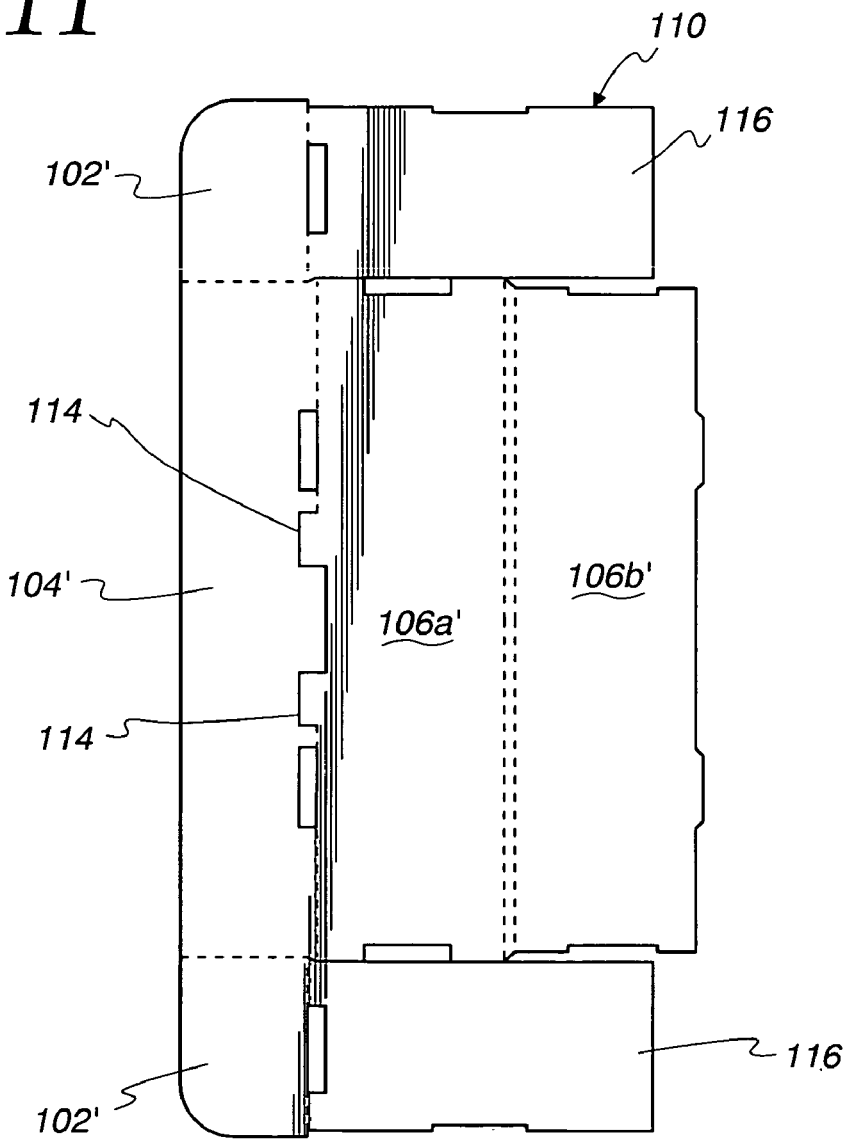
FIG. 11 is a plan view of a blank therefor.

Referring now to FIGS. 1, 10 and 11, adjustable shipper display system 10 utilizes open front shelves 100. Open front shelf 100 includes end walls 102, rear wall 104 and bottom wall 106. Referring to FIG. 11, blank 110 is provided for erection of shelf 100. Blank 110 includes a central floor portion 106*a*' located adjacent an overlying floor portion 106*b*'. Rear wall portion 104' is joined to floor portion 106*a*' along a construction line which includes a score portion indicated in dotted form and a full cut portion indicated in solid line form. The solid line form includes rearwardly extending tabs 114 which engage slots 70 in rear wall 24 of the display shelf. Manufacturing tabs 116 are joined to end wall portions 102' and are held captive between floor portions 106*a*', 106*b*' when the shelf is erected.

Figure 12:
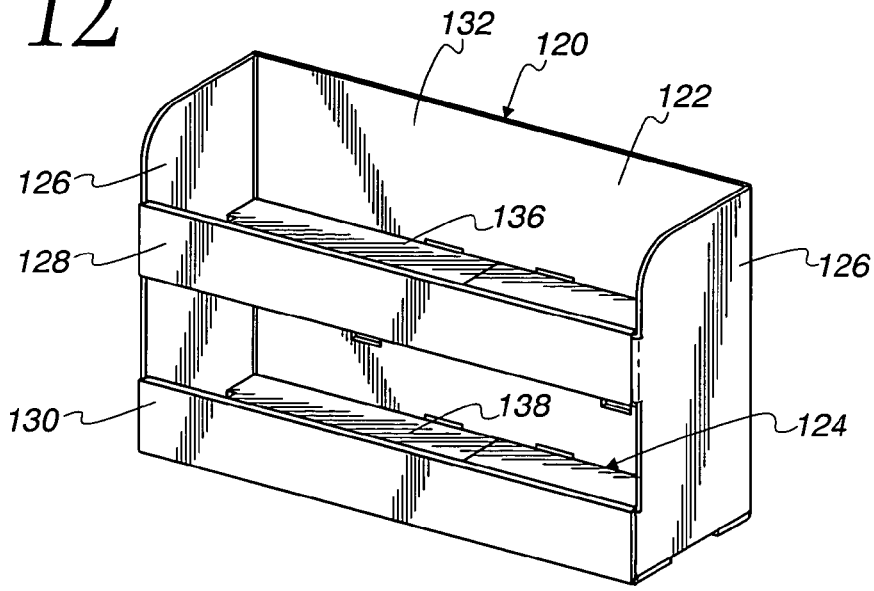
FIG. 12 is a perspective view of a double tier shelf.
Figure 13A:
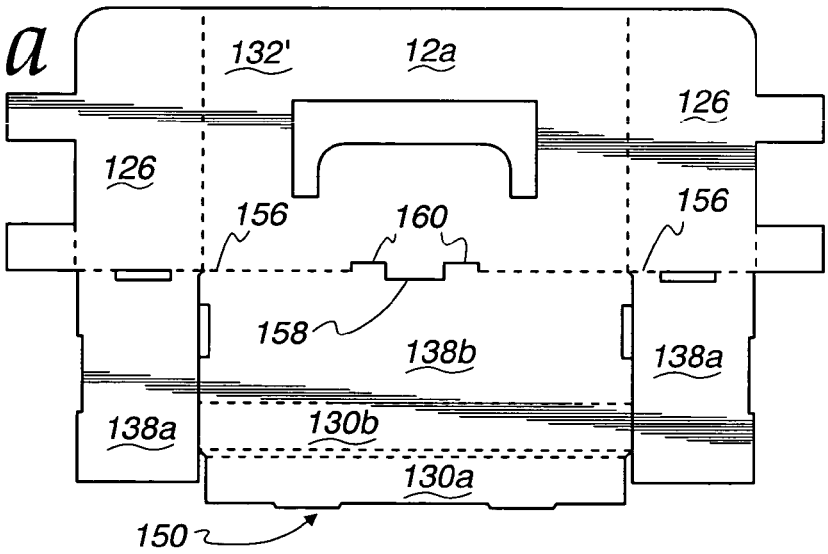
FIGS. 13*a* and 13*b* are plan views of carton blanks therefor.
Figure 13B:
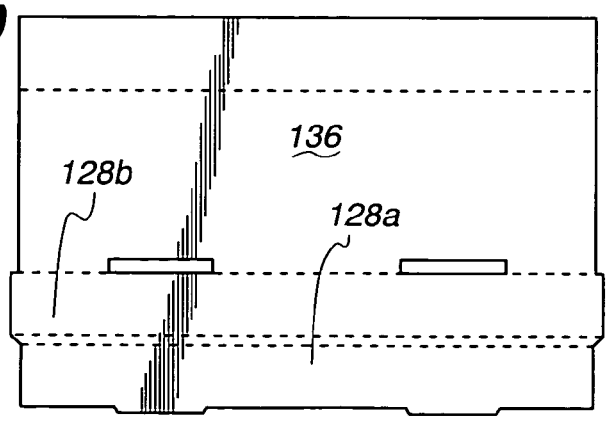

Turning now to FIG. 12, a double tier shelf 120 includes upper and lower bin-style shelves 122, 124. Included are side walls 126 extending across both and top bottom shelves and front walls 128, 130 for each shelf. Rear wall 132 and floor portions 136, 138 complete the formation of the bin-style shelves. When fully erected, the double tier shelf 120 comprises a rigid unitary component having rearwardly extending tabs received in the slots 70 of the master shell 24. Three double tier shelves are installed in the master shell to form the adjustable shipper display system 16 shown in FIG. 1. Referring now to FIGS. 13*a*, 13*b*, 26 and 27, construction of the double tier shelf will now be described. With reference to FIGS. 13*a*, 13*b* carton blanks 150, 152 are provided, respectively. Carton blank 150 includes double layer front wall portions 130*a*, 130*b* which are folded so as to overlie one another, with front wall portion 130*a* interlocking with floor portion 138*b*. Floor portions 138*a* are located on either side of floor portion 138*b* and are folded toward one another so as to overlie floor portion 138*b*. The full height rear wall portion 132' is joined to floor portion 138*b* by a construction line including a central cut portion 158 positioned between score portions 156. Cut portion 158 includes rearwardly extending tabs 160 which engage slots in the rear wall of the master shell. The blank 150 is folded and locked together in the manner indicated in FIG. 26.

Figure 27:
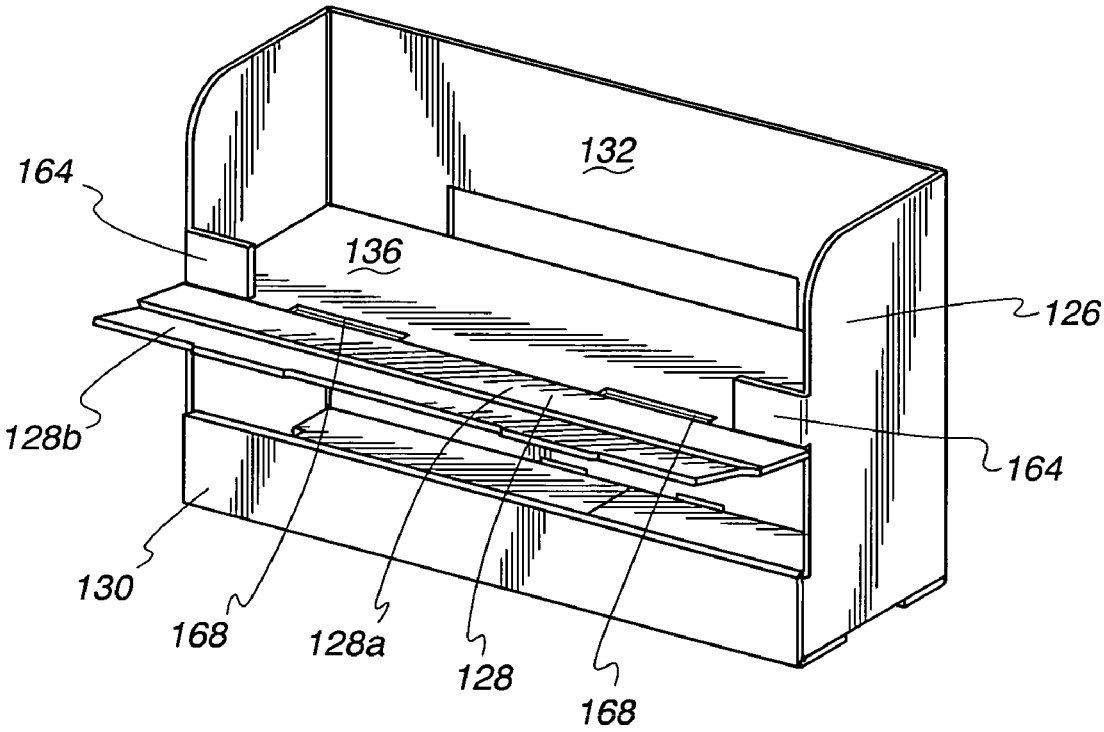
FIG. 27 is a perspective view similar to that of FIG. 26 but with the second component having been added, prior to final assembly.

Turning to FIGS. 13*b* and 27, blank member 152 includes floor portion 136 and front wall portion 128 of the upper shelf 122 shown in FIG. 12. When erected, the blank 152 is interlockingly inserted within the erected blank 150 in the manner shown in FIG. 27. Tabs 164 extend from side walls 126 so as to be trapped between overlying front wall layers 128*a*, 128*b*. Tabs extending from the free edge of wall portion 128*b* interlock with slots 168 formed in floor 136.

Figure 19:
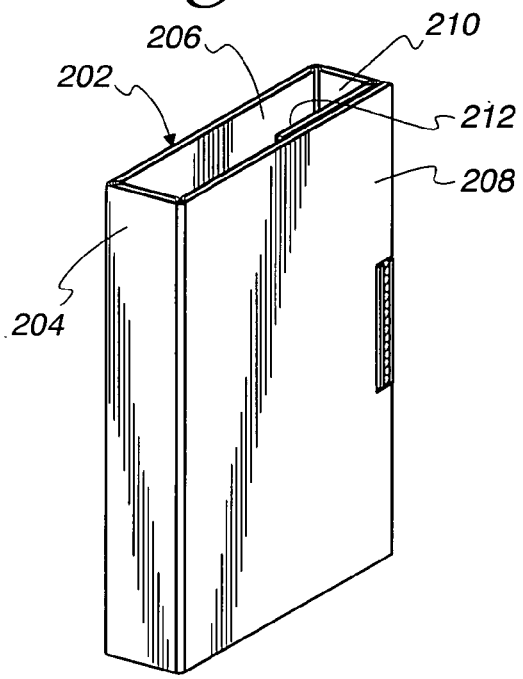
FIG. 19 is a perspective view of a first filler member.
Figure 20:
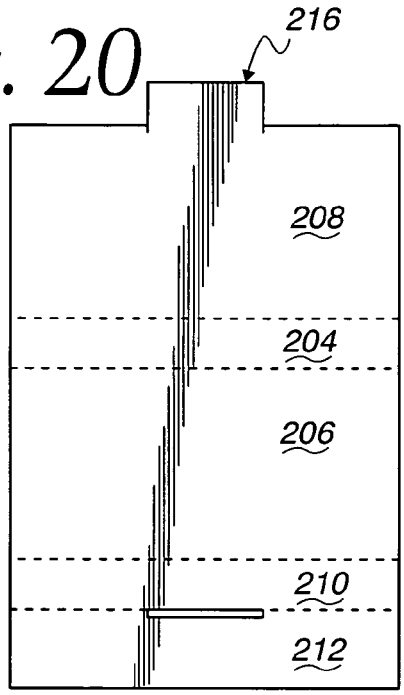
FIG. 20 is a top plan view of a blank therefor.

Referring to FIGS. 19-24, three examples of filler members and their blanks are shown. Referring to FIG. 3, three fillers 202 are employed, one in each bin-style shelf 44. The fillers 202 resemble shelf dividers as can be seen for example of the upper right corner of FIG. 1. Fillers 202 provide dunnage as required to accommodate particular articles arranged side-by-side on a given shelf. Thus, a standardized width shelf can be used to accommodate a variety of different sized articles. The dividers described herein can be employed with any of the shelves herein described. Referring to FIG. 19, divider 202 can be seen to have a hollow rectangular tubular structure. Filler 202 includes a front wall 204, opposed side walls 206, 208, a rear wall 210 and a manufacturing tab 212. A blank 216 from which filler 202 is fabricated is shown in FIG. 20.

Figure 21:
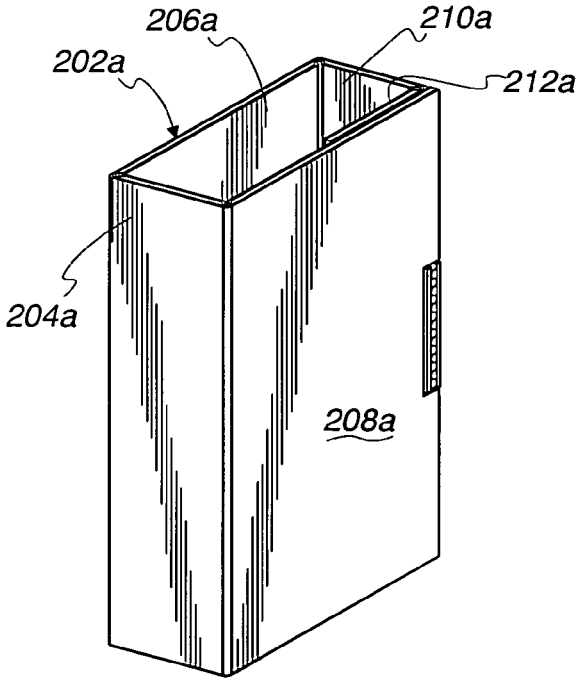
FIG. 21 is a perspective view of a second filler member.
Figure 22:
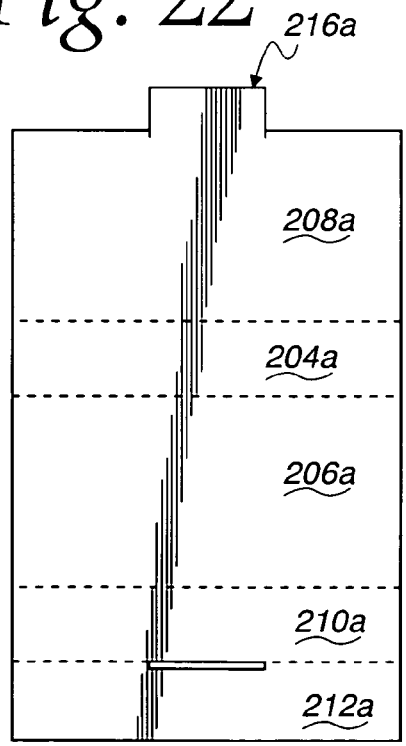
FIG. 22 is a top plan view of a blank therefor.
Figure 23:
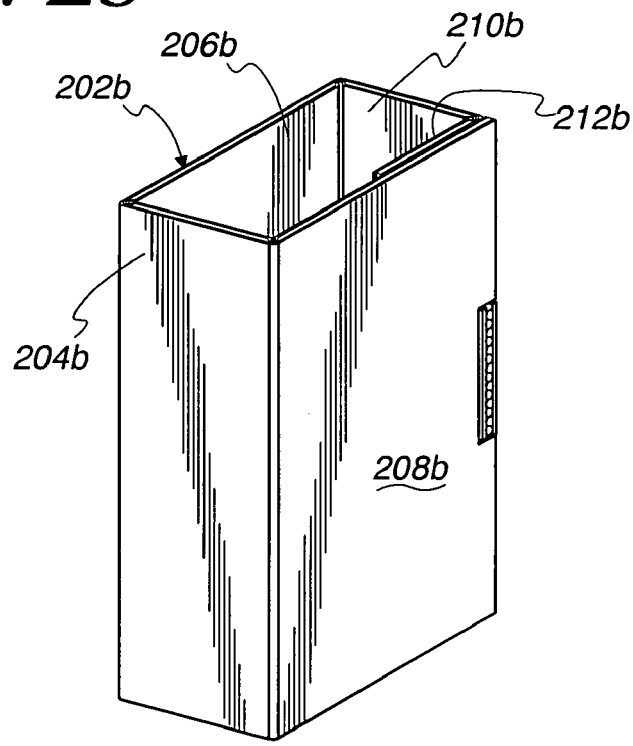
FIG. 23 is a perspective view of a third filler member.
Figure 24:
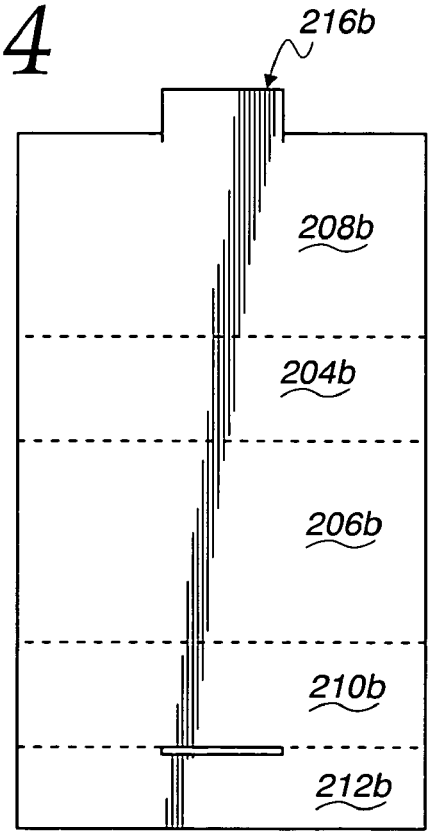
FIG. 24 is a top plan view of a blank therefor.

FIGS. 21 and 23 show filler members similar to that of 202 in FIG. 19, except for the width of the filler member. The fillers 202*a*, 202*b* in FIGS. 21 and 23 have widths double and triple the width of filler 202, respectively. As will be appreciated, the fillers and filler blanks of FIGS. 21-24 are identical to those of FIGS. 19 and 20 except for width-wise dimensions. Accordingly, the same reference numerals used in FIGS. 19 and 20 are used in FIGS. 21-24 with the suffix character a being used for the double wide embodiment of FIGS. 21 and 22 and the suffix character b being used for the triple wide embodiment of FIGS. 23 and 24.

Figure 17:
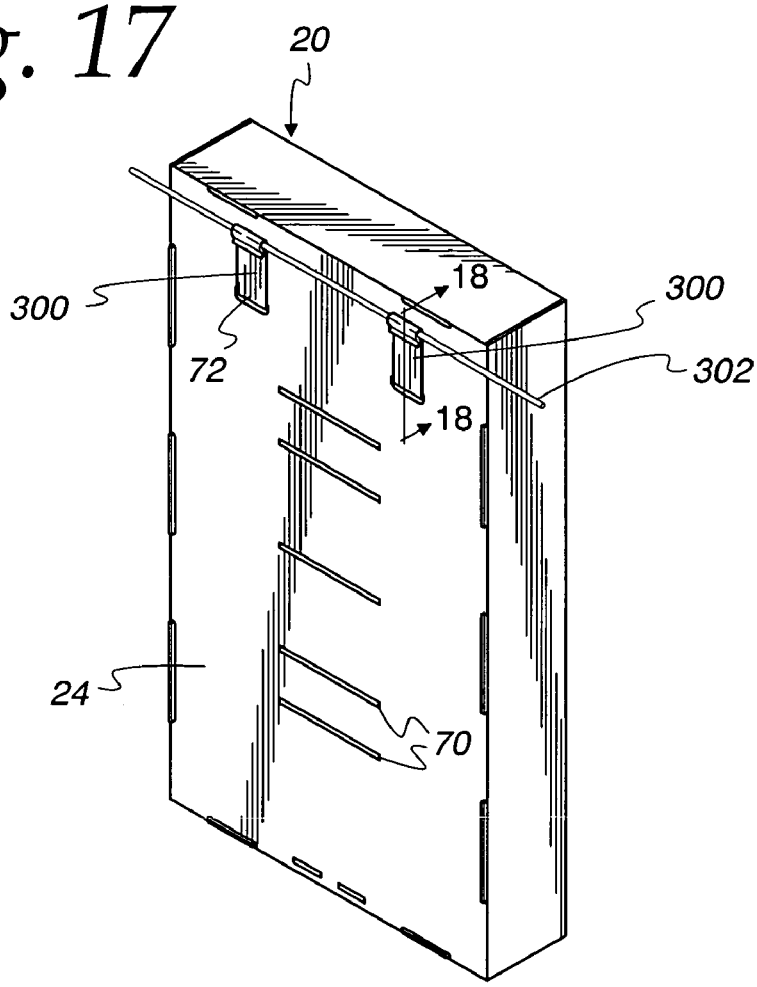
FIG. 17 is a rear perspective view of a master shell.
Figure 18:
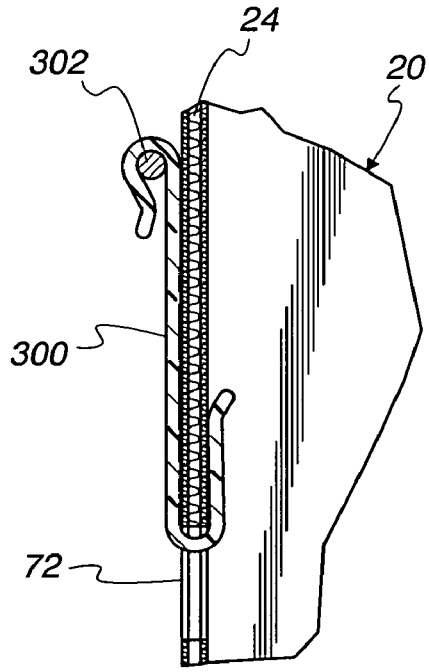
FIG. 18 is a cross-sectional view taken along the line 18-18 of FIG. 17.

Turning now to FIGS. 17 and 18, hanging clips 300 have a generally S-shaped configuration as can be seen in FIG. 18. The lower hook portion of clip 300 is received in opening 72 formed in rear wall 24 of master shell 20. The upper hook-shaped portion of clip 300 engages a wire element 302 of a wire rack or other support fixture. With clips 300, the master shell and its accompanying adjustable shipper display system can be displayed in the hanging position, as well as a free-standing position.

Figure 14:
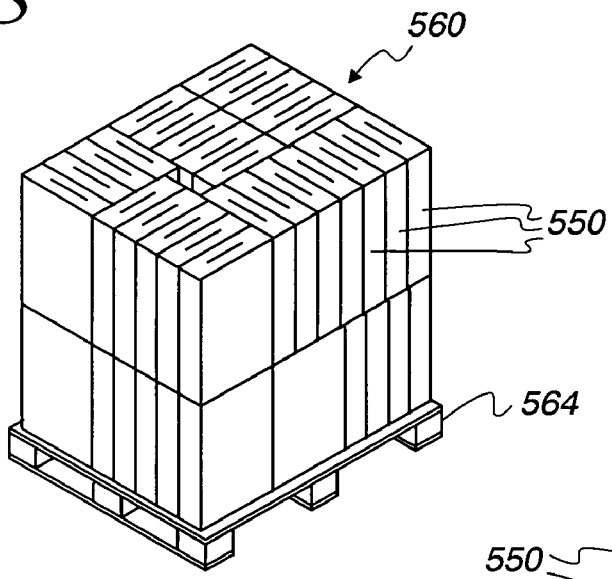
FIGS. 14-16 are perspective views of palletized loads utilizing adjustable shipper display systems according to principles of the present invention.
Figure 15:
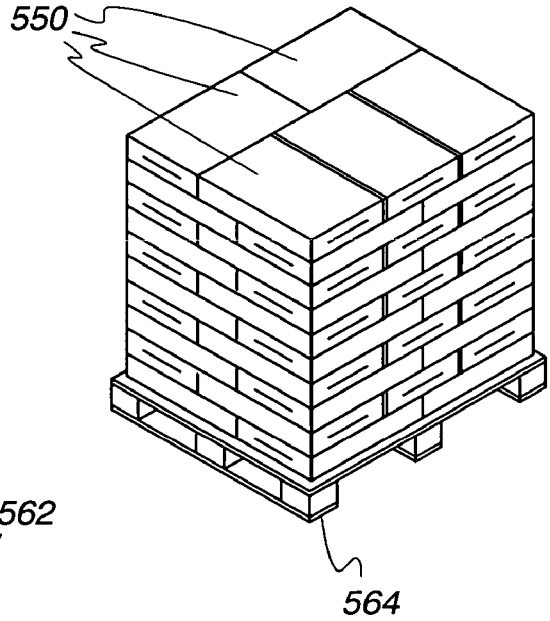
Figure 16:
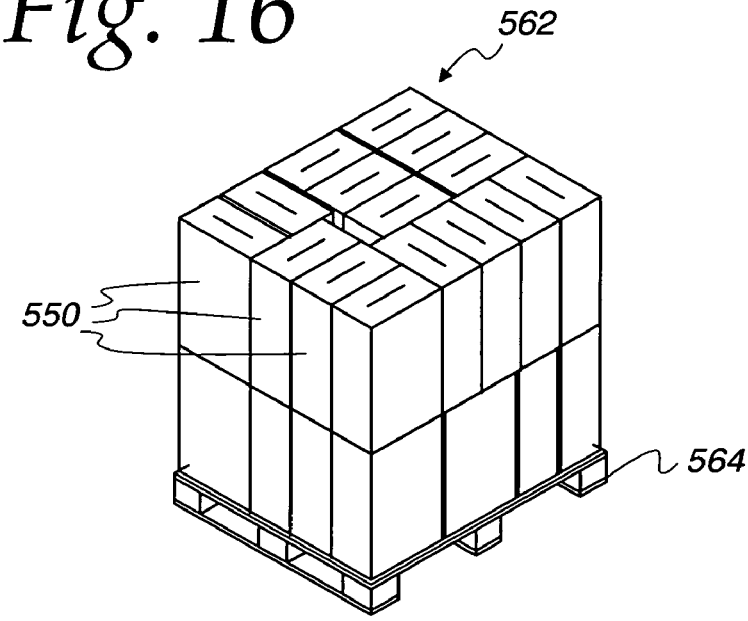
Figure 25:
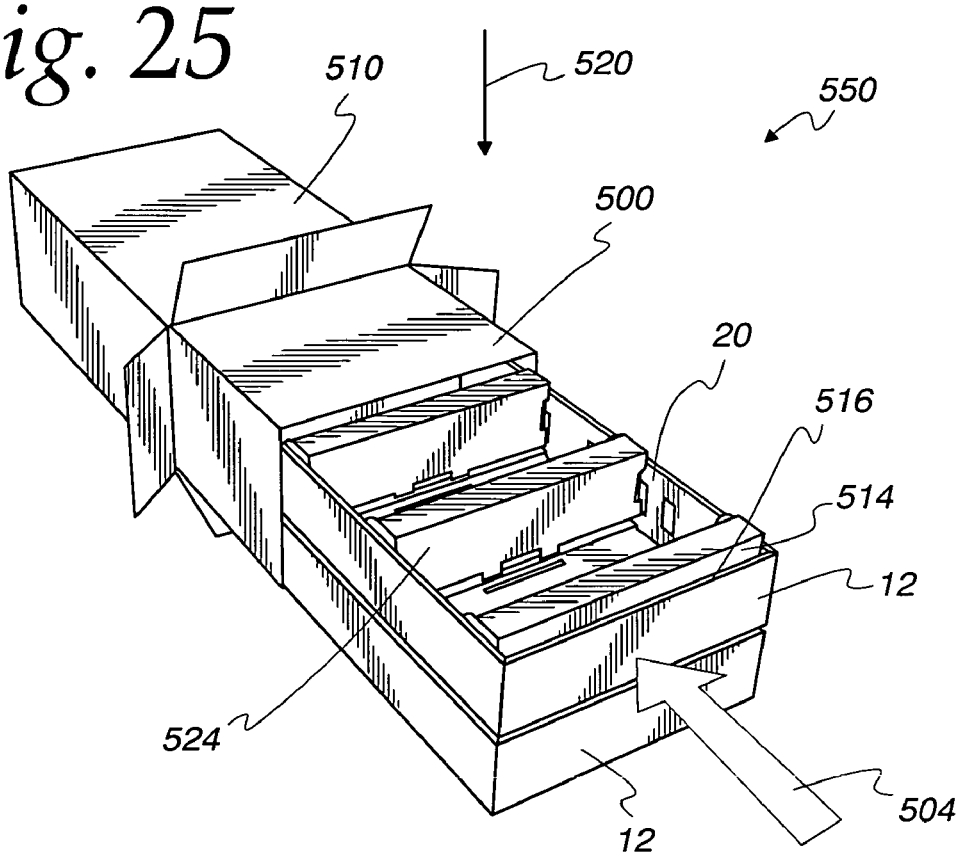
FIG. 25 is a perspective view of adjustable shipper and display systems being prepared for transport.
Figure 26:
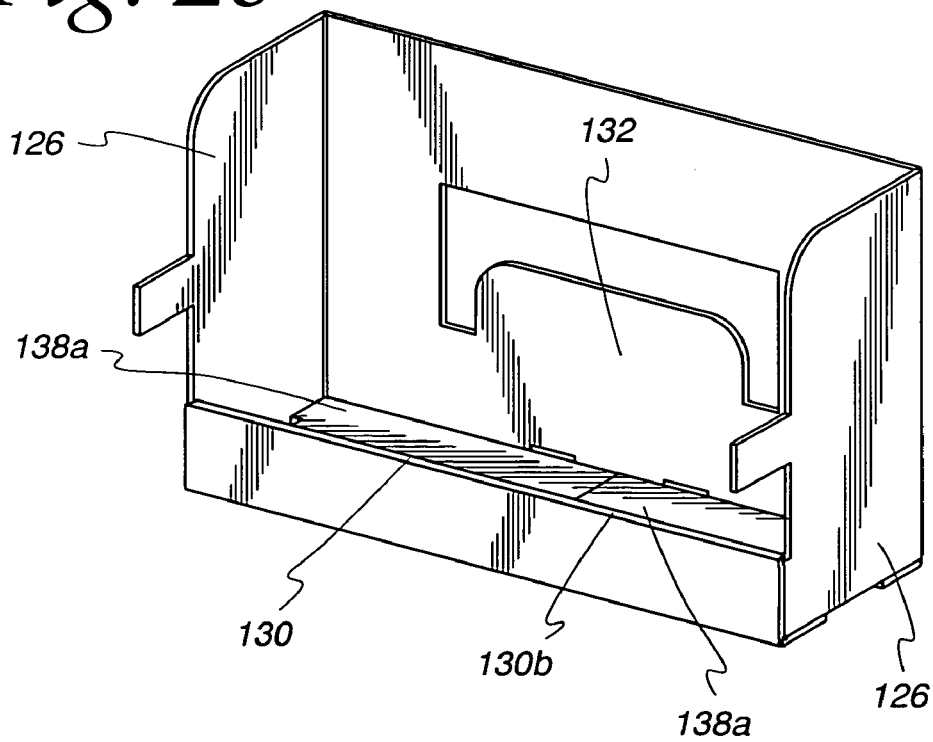
FIG. 26 is a perspective view of the first carton component for the double tier shelf.

Turning now to FIGS. 14-16, palletized loads of pluralities of adjustable shipper and display systems are shown. In FIG. 14, shipper display systems such as those illustrated in FIG. 1 are arranged in a vertical orientation and in FIG. 15 are shown oriented in a horizontal orientation. Turning now to FIG. 25, two adjustable shipper display systems 12 are arranged in overlying relation, as shown in preparation for transport. A sleeve 500 is provided to enclose the open front of the top system 12 and provides protection from dust and, optionally, extra cushioning. The systems 12 and sleeve 500 are then slid in the direction of arrows 504 into a wrapper carton 510. Preferably, carton 510 is of conventional rectangular-pinwheel design. Optionally, sleeve 500 and carton 10 can be reduced in size to accommodate a single adjustable shipper display system. Although three shelf systems 12 are shown in FIG. 25, the arrangement of FIG. 25 can be employed with any of the adjustable shipper display systems herein.

As indicated in FIG. 25, the shelves disposed within the master shell can have a depth greater than that of the master shell. For example, a portion 514 can be seen to extend beyond the upper edge 516 of master shell 20. The rigidity and strength of the shelf constructions is sufficient to withstand pressures in the direction of arrow 520 exerted on the overall assembly 550 illustrated in FIG. 25. If desired, additional strengthening in the form of dividers illustrated herein can be employed to provide additional compression strength. The major surfaces of the dividers are preferably located at the upper end of each shelf portion. For example, a divider for the lowermost shelf portion would be placed against surface 524 of the superior shelf. Although overhang of the shelves of increased depth can be readily accommodated by the present invention, the shelves could also be made to extend flush with the free edge 516 of the master shell or could be recessed below the master shell. In the latter arrangement, it is generally desirable to provide fillers at the front edge of the shelves or dividers at the upper ends of each shelvage portion of the master shell interior, so as to extend to the free edge 516 of the master shell to prevent compressive loadings on the master shell side walls.

Turning now to FIGS. 14-16 various arrangements of palletized loads of adjustable shipper display systems are shown. Referring to FIGS. 14 and 16, palletized load arrangements 560, 562 provide vertical stacking of the shipping arrangements 550. In FIG. 14, pluralities of shipping arrangements 550 are oriented in an upright position about pallet 564. In FIG. 14, the shipper assemblies 550 are similar to the arrangement shown in FIG. 25 except that a single adjustable shipper display system is contained within the carton 510. In FIG. 16, shipper arrangements 550 are also oriented in a vertical direction about pallet 564, except that a double adjustable shipper display system arrangement of FIG. 25 is employed. It will be appreciated by those skilled in the art that the present invention provides for modular shipping procedures, thus adding additional value for a manufacturer or merchandiser. In FIG. 15, the shipping assemblies 550 are oriented in a generally horizontal direction about pallet 564. If desired, the horizontal and vertical dimensions of the shipping assemblies involved can be made to be integral multiples of a common measurement unit. Adjustments to particular shipping arrangements can be made by adding filler materials within the wrapper cartons 510 to prevent the adjustable shipper display systems from moving within the wrapper carton 510, during transport.

Referring now to FIGS. 29-33, a shipper display system generally indicated at 600, includes a master shell 602 similar to the master shell 20 described above. Master shell 602 includes side walls 604, 606 each having a similar array of voids or slots 608. Preferably, the side walls 604, 606 are of double-ply construction and the slots are formed in one of the plies.

Figure 30:
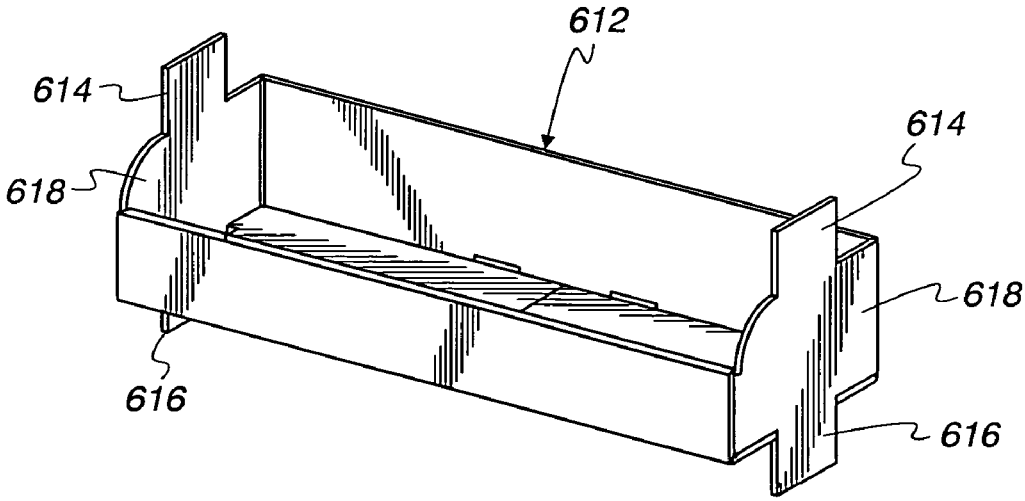
FIG. 30 is a perspective view of a bin-style shelf therefor.

With additional reference to FIG. 30, shipper display system 600 includes a bin-style shelf 612. In its preferred form, bin-style shelf 612 is similar to bin-style shelf 44 described above except for flaps 614, 616 extending above and below the end walls 618. In use, the flaps 614, 616 are inserted into slots 608 and master shell 602 to provide secure mounting at the mid portion of each end wall 618, without the use of comaterial devices such as plastic clips or the like.

Figure 31:
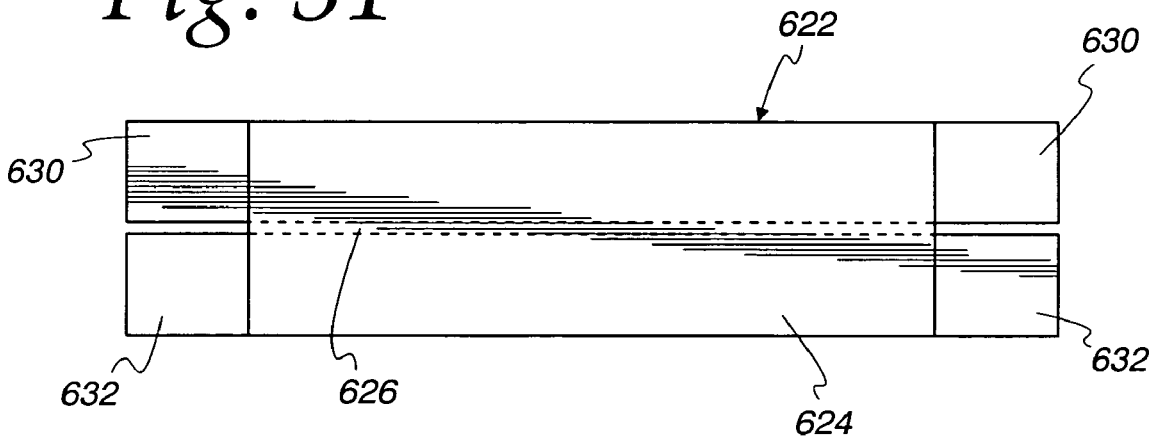
FIG. 31 is a plan view of a carton blank.
Figure 32:
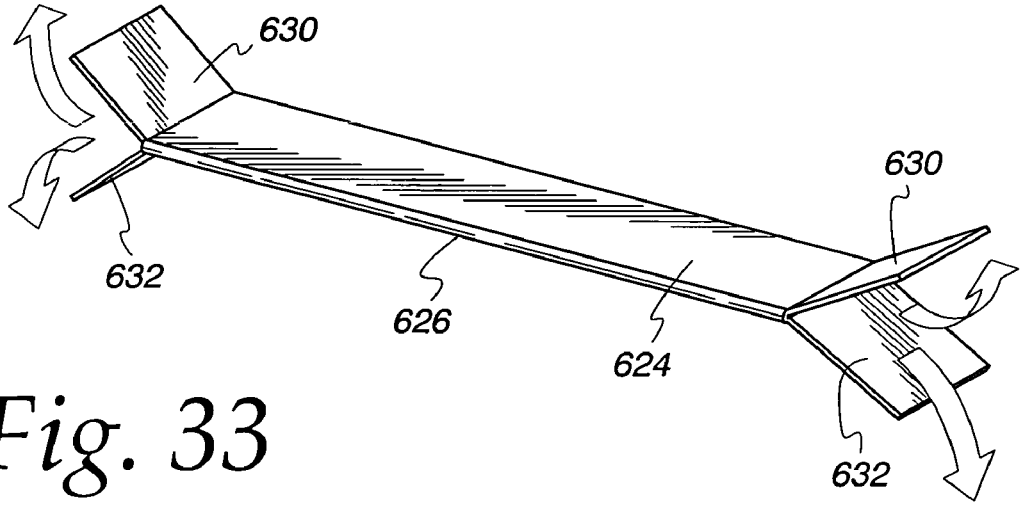
FIG. 32 shows partial folding and erection of the carton blank of FIG. 31.
Figure 33:
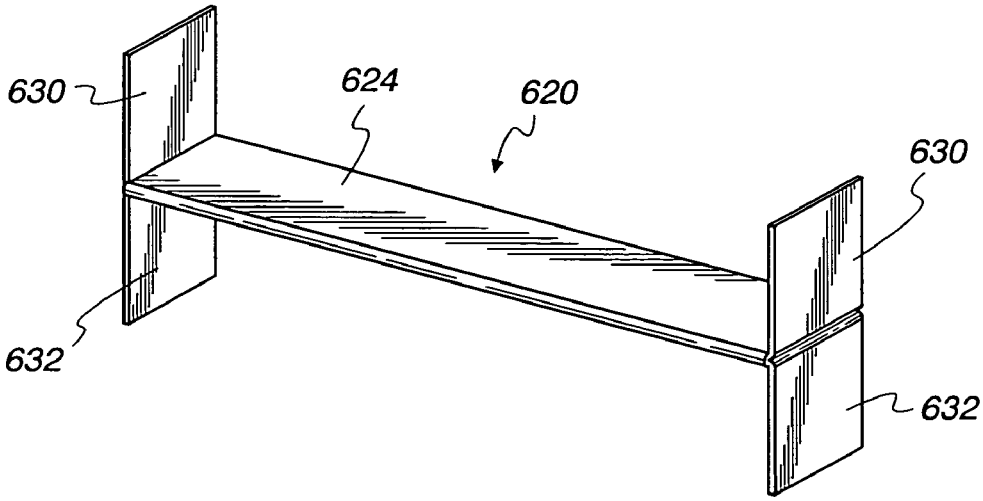
FIG. 33 shows a shelf fully erected using the blank of FIG. 31.

Referring now to FIGS. 31-33, a shelf member 620 (see FIG. 33) is made from an integral blank 622, preferably of paperboard material (see FIG. 31). Blank 622 includes a body portion 624 folded along its longitudinal center line 626. Wings 630, 632 extend from each end of the body portion 624 and, as indicated in FIG. 32 are folded at angles to the folded body portion to form mounting members similar to the flaps 614, 616 described above and referenced at FIG. 30. In use, the wings 630 632 are foldingly inserted in slots 608.

Figure 29:
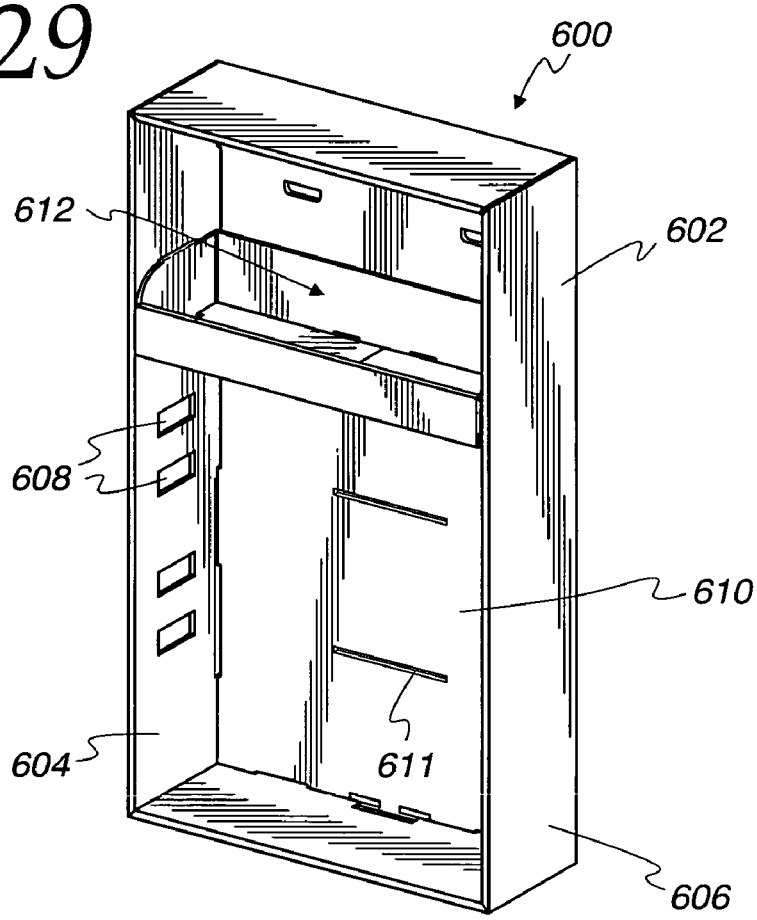
FIG. 29 is a perspective view of an adjustable shipper display system according to principles of the present invention.

As can be seen herein, convenient and reliable mounting of shelves within the master shelf is accomplished in a low cost manner which avoids the use of plastic clips and other comaterial devices. Further, support can be conveniently provided at a mid point of the shelf end walls, spaced from the rear wall 610 of the master shell. This provides an improved single point mounting of the improved stability for each shelf, without requiring additional support to stabilize the shelf front-to-back. If desired, the shelf can be provided with rearwardly extending tabs, as described above, to be inserted in the slots 611 formed in rear wall 610 (FIG. 29). However, with mounting flaps or wings described above, support features engaging rear wall 610 have been found unnecessary.

Figure 34:
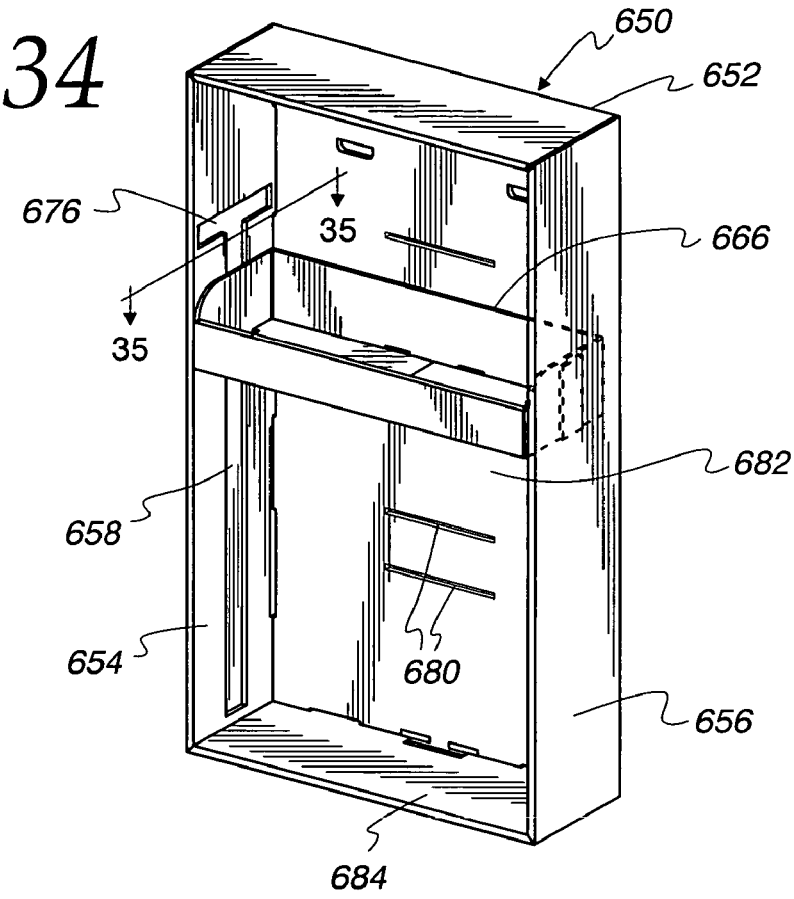
FIG. 34 is a perspective view of another adjustable shipper display system according to principles of the present invention.
Figure 35:
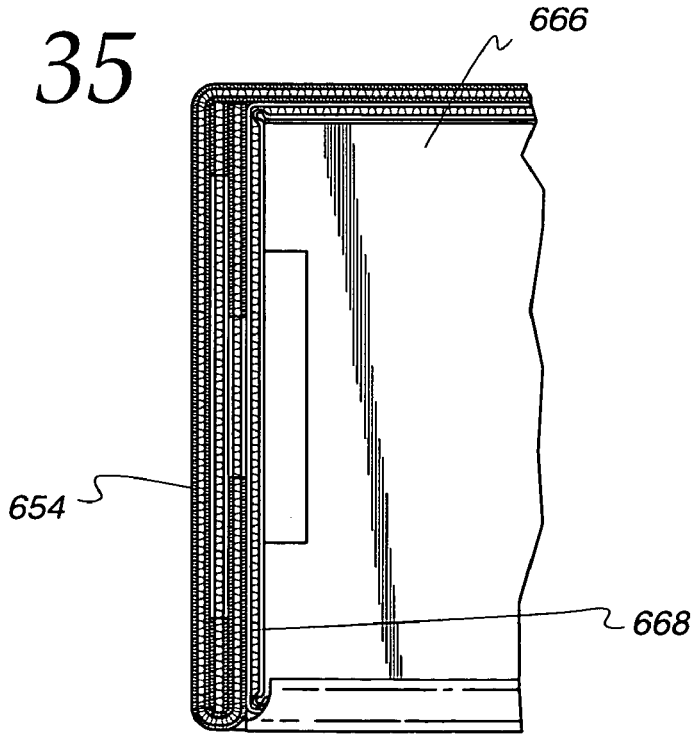
FIG. 35 is a cross-sectional view taken along the line 35-35 of FIG. 34.
Figure 36:
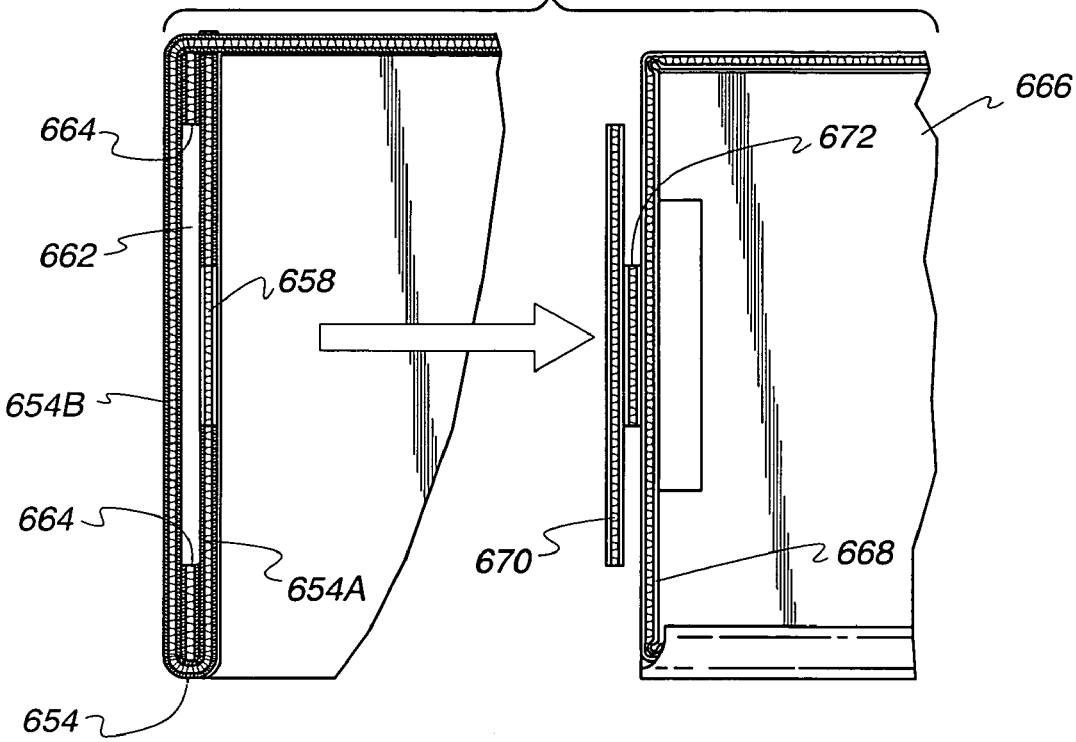
FIG. 36 is a fragmentary view of an enlarged portion of FIG. 35.
Figure 37:
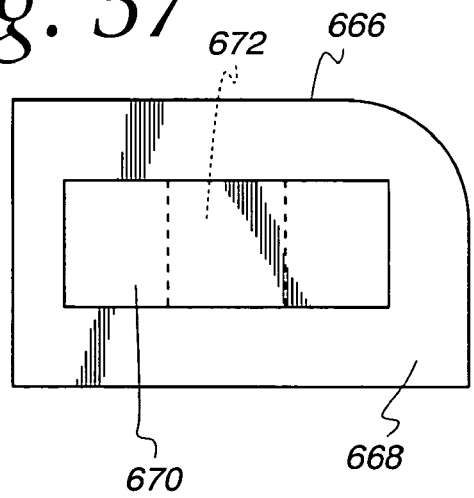
FIG. 37 is an end view of the bin-style shelf of FIG. 34.

Turning now to FIGS. 34-37, a shipper display system providing vertically sliding mounting is indicated at 650. Included is a master shell 652 having side walls 654, 656, preferably of dual-ply paperboard construction. A vertically extending slot 658 is formed in each side wall 654, 656. Referring to FIG. 36, a gap 662 is formed between the side wall plies 654A, 654B. Slot 658 communicates with spacing 662, and these features extend throughout the height of the mounting slot. In the preferred embodiment, spacer members 664 provide a convenient separation of the side wall plies.

A bin-style shelf 666 is shown mounted within the master shell 652. Shelf 666 includes end walls 668 and, as shown in FIG. 36, a mounting panel 670 is secured to end wall 668 by a spacer 672. As indicated in FIG. 34, an enlarged opening 676 is provided at the top of slot 658 to allow introduction of mounting panel 670 within the spacing 662 located between the plies of master shell side wall 654. The sliding engagement between shelf 666 and master shell 652 is illustrated in FIG. 35. Shelf 666 is slided vertically downwardly to its desired position within master shell 652. Engagement between mounting panel 670 and the plies of master shell side wall 654 is sufficient to securely position the shelf at a desired vertical location within the master shell. However, it is recognized that vibration during shipping and handling may, in some instances, result in an unintentional vertically downward shifting of the shelves within the master shell. Accordingly, the shelf may be provided with rearwardly extending protrusions as described above, receivable in slots 680 formed in the rear wall 682 of the master shell, as illustrated in FIG. 34. Other vertical stop devices could be employed as well, such as vertically extending dunnage members inserted between floor 684 of the master shell and the lower most shelf, and between adjoining shelves.

Figure 38:
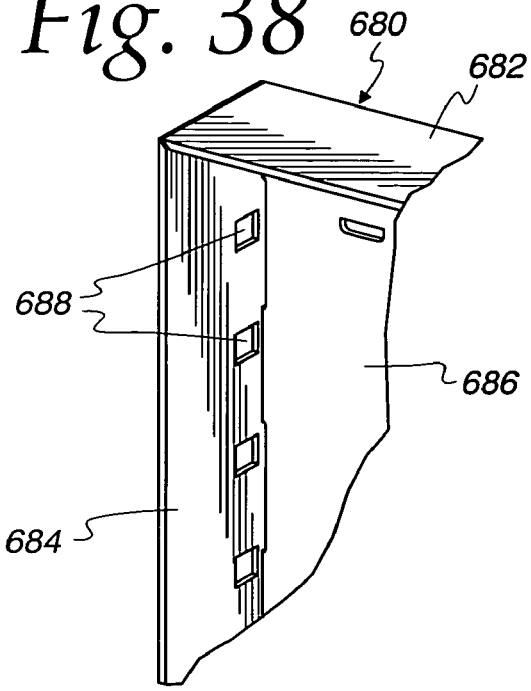
FIG. 38 is a fragmentary perspective view of a further adjustable shipper display system according to principles of the present invention.
Figure 39:
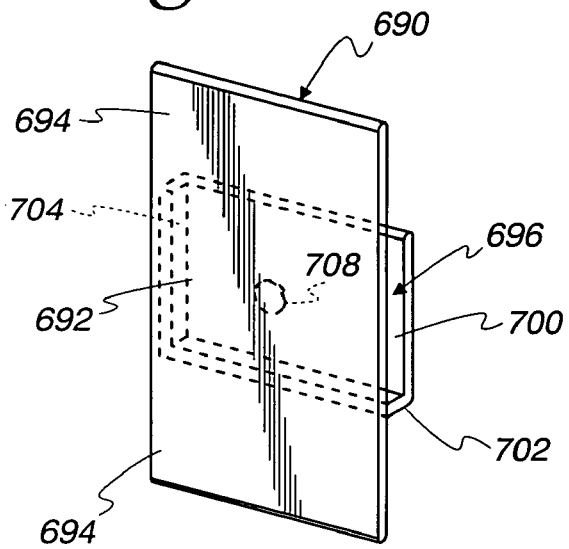
FIG. 39 is a perspective view of a mounting clip therefor.
Figure 40:
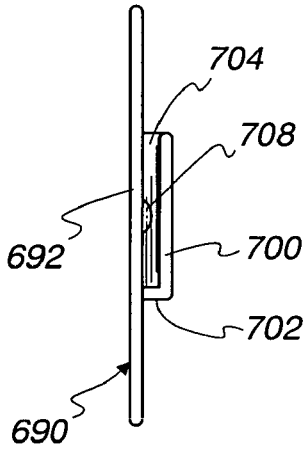
FIG. 40 is a front elevational view of the mounting clip of FIG. 39.
Figure 41:
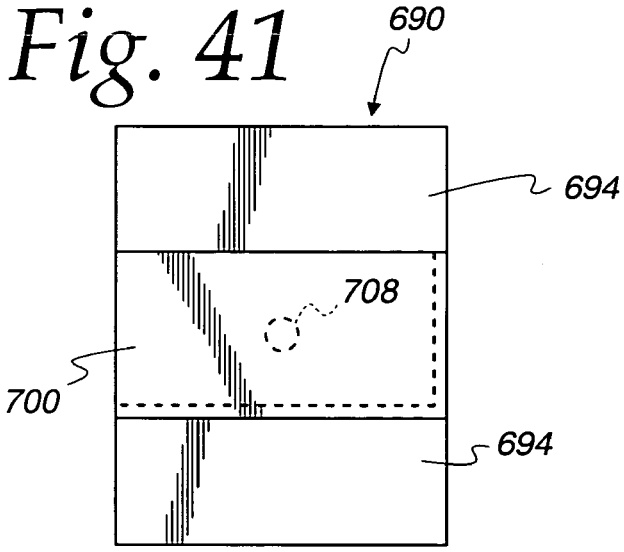
FIG. 41 is a side elevational view of the mounting clip of FIG. 39.
Figure 42:
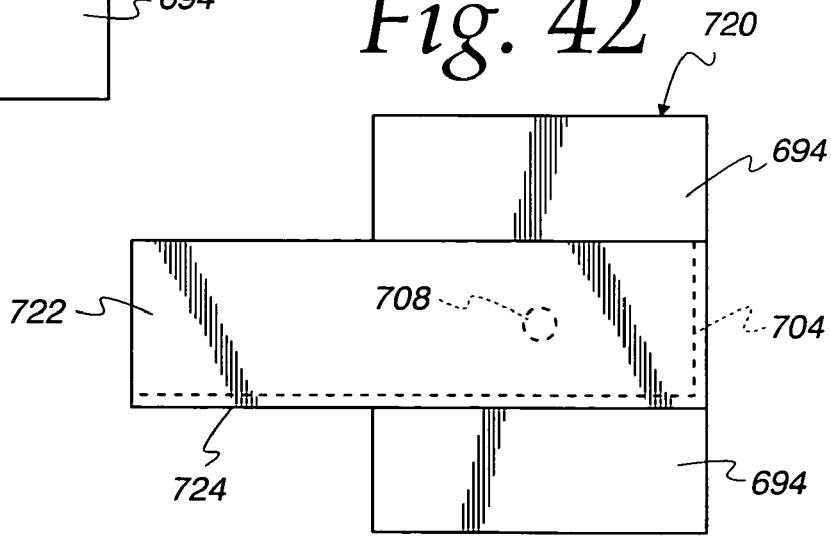
FIG. 42 is a side elevational view of a mounting clip similar to that shown in FIG. 41 but having an elongated configuration.

Referring now to FIGS. 38-46, an alternative shipper display system is generally indicated at 680 (FIG. 38). The shelf and mounting clips of system 680 have been omitted from FIG. 38 for purposes of clarity. Included in the system, is a master shell 682 having a side wall 684 and a rear wall 686. Slots 688 are formed in side wall 684 and are located generally adjacent rear wall 686. FIG. 39 is a perspective view of a mounting clip 690 having a generally flat wall 692 with upper and lower wing portions 694. Mounting clip 690 further includes a pocket 696 including a side wall 700, bottom wall 702 and a rear wall 704. As can be seen, for example in FIG. 40, a protrusion 708 is located within the pocket extending from wall 692. If desired, protrusion 708 could protrude from side wall 700. As indicated in FIG. 41, tab portions 694 have a substantial height with respect to the height of side wall 700.

Figure 43:
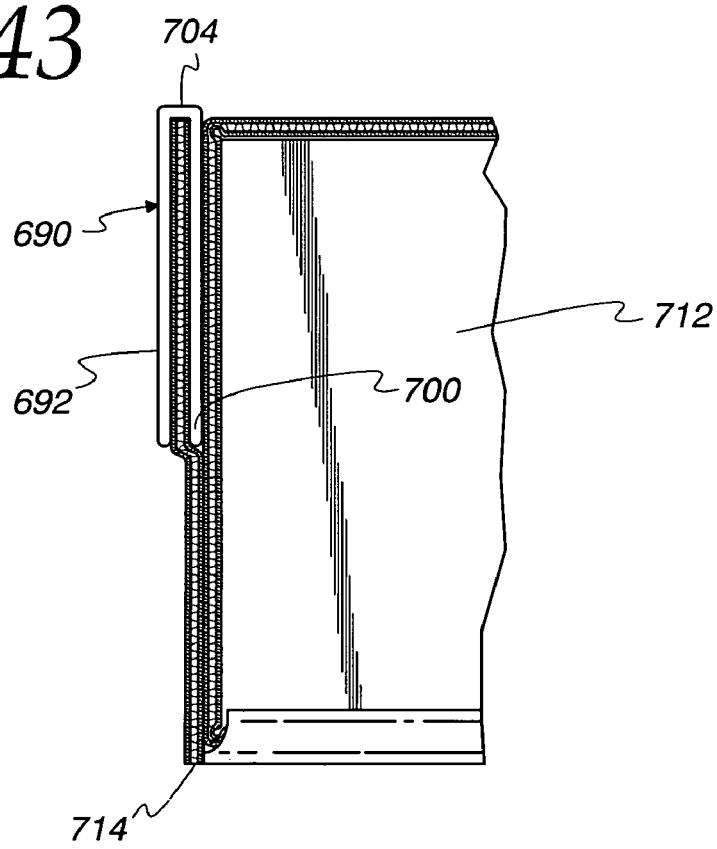
FIG. 43 is a fragmentary top plan view of the bin-style shelf with the mounting clip of FIG. 39 installed.
Figure 44:
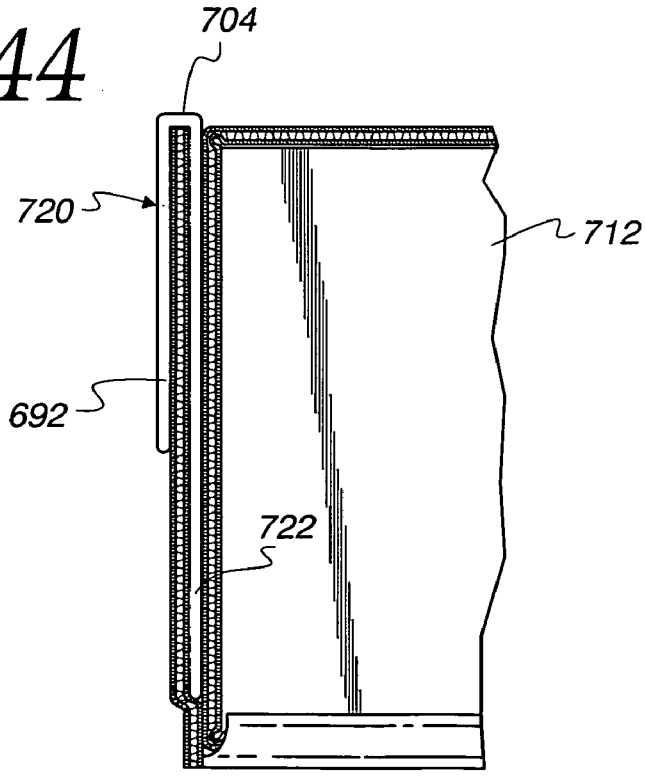
FIG. 44 is a fragmentary top plan view of the bin-style shelf with the mounting clip of FIG. 42 installed.
Figure 45:
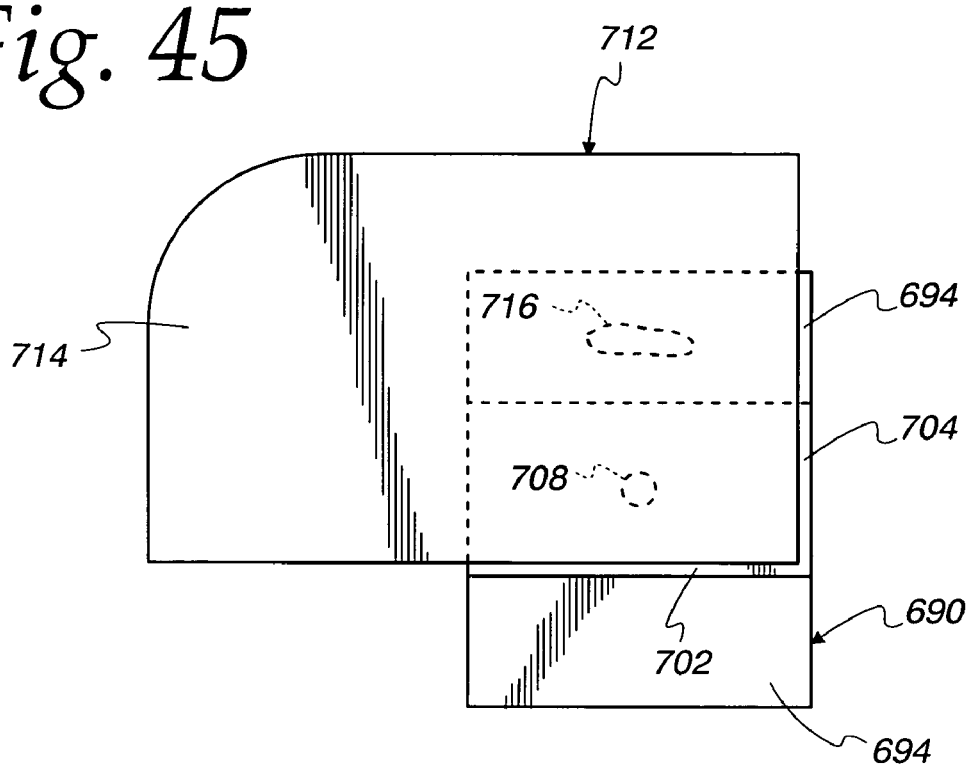
FIG. 45 is an end view of the bin-style shelf with the mounting clip of FIG. 39 installed.

Referring additionally to FIGS. 43 and 45, a bin-style shelf 712 has dual-ply end walls 714 of mirror image construction. As shown, side wall 700 is received between the plies of the shelf end wall with the outermost ply being held within the pocket portion of mounting clip 690. With reference FIG. 45, the plies of shelf end wall 714 may be secured together with an adhesive 716 to assist protrusion 708 in holding the shelf end wall captive with the mounting clip 690. It is generally preferred that the mounting clip 690 be installed within master shell 682 by inserting the flap portions 694 of the mounting clip in slots 688 of master shell 682. The shelf 712 is then inserted within master shell 682 until the rear portion of the shelf end walls are received in the pocket portions of the mounting clips in the manner indicated in FIG. 43.

Figure 46:
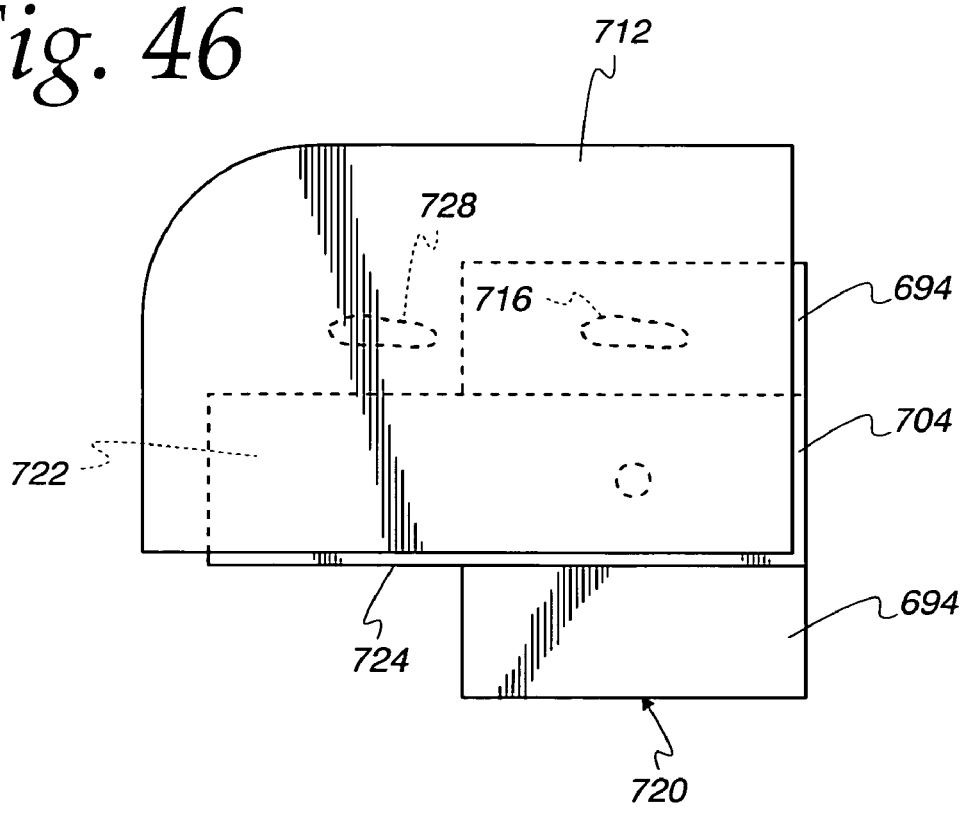
FIG. 46 is an end view of a bin-style shelf with the elongated mounting clip of FIG. 42 installed.

As indicated in FIG. 38, slots 688, and hence mounting clips 690, are located toward the rear of the master shell interior, generally adjacent rear wall 686. Depending upon the relative proportions of the shelf depth and a mounting clip, the shelves might appear "front heavy" causing the front of the shelf to tip downward. If desired, conventional support can be secured to side walls 684 underneath the front of the installed shelves. Optionally, vertical dunnage members can be inserted between shelves and the floor of the master shell to provide added support against tipping. As a further alternative, an optional mounting clip 720, illustrated in FIGS. 42, 44 and 46, could be employed. Clip 720 generally resembles clip 690 described above except for a forwardly elongated side wall 722 and floor 724. As indicated in FIG. 46, the side wall 722 and floor 724 can be extended throughout a substantial portion of the depth of the shelf 712. If desired, an additional internal glue joinder 728 between the plies of the shelf end wall can be employed to further captivate the forward end portion of side wall 722 between the end wall plies. In order to provide weight reduction, the flat wall of clip 720 is not extended, leaving the forward portion of the pocket open or single-sided as can be seen, for example, in the bottom left portion of FIG. 44. If desired, the flat wall 692 in FIG. 44 can be extended in a downward direction so as to more completely overlie wall 722 and can be made coterminous therewith.

Regardless of which mounting clip, the shorter clip 690 or the longer clip 720, is utilized, substantial advantages are enjoyed in commercial scale, high speed packaging environment. If desired, the shelves can be inserted within the master shell prior to loading of product. However, it is preferred that product be loaded onto the shelves beforehand and that the loaded shelves are inserted within the master shell and engaged by the mounting clip to hold the loaded shelf in position. The invention is particularly advantageous when employed with automated loading equipment, since the shelves are mounted with a simple front-to-back movement. The same single direction mounting of shelves within the master shell are accomplished with the arrangements illustrated in FIGS. 47-59.

Figure 47:
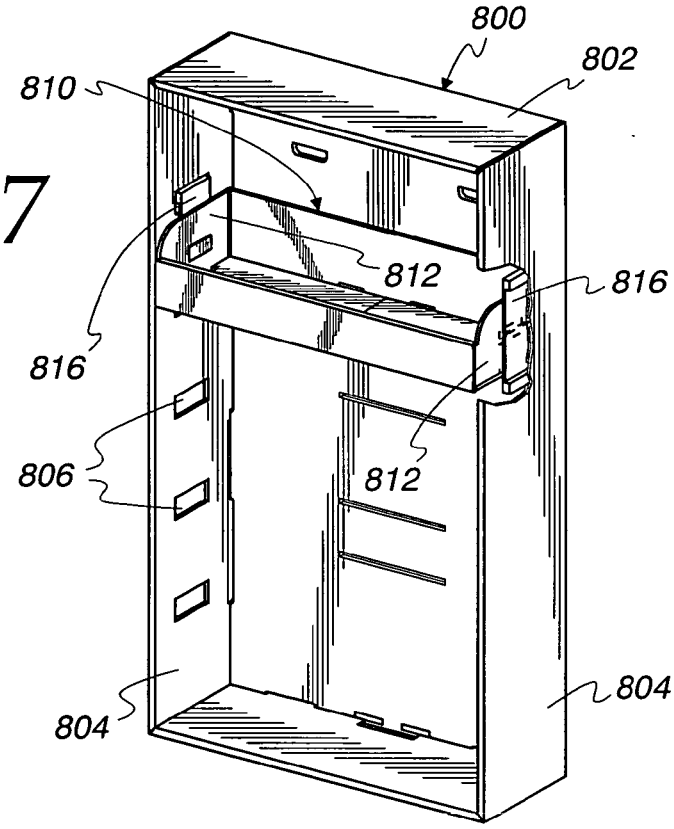
FIG. 47 is a perspective view of another adjustable shipper display system according to principles of the present invention.
Figure 48:
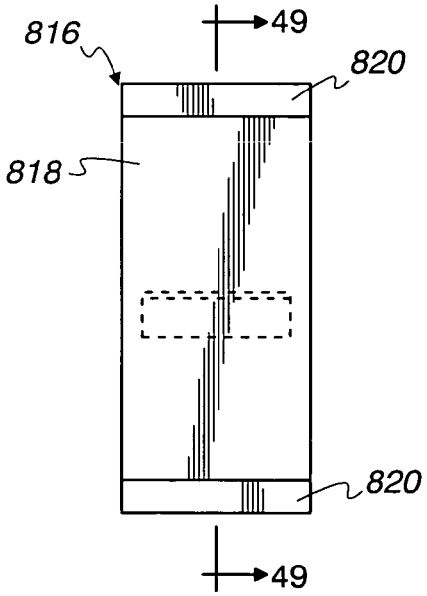
FIG. 48 is a front elevational view of the mounting clip therefor.
Figure 49:
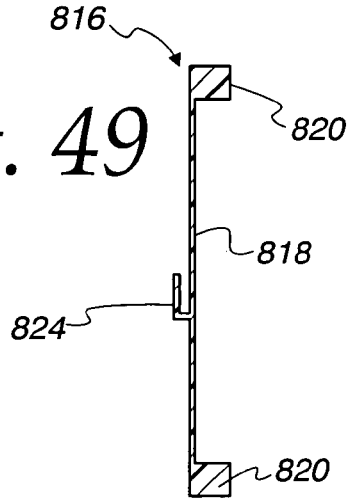
FIG. 49 is a cross-sectional view taken along the line 49-49 of FIG. 48.
Figure 50:
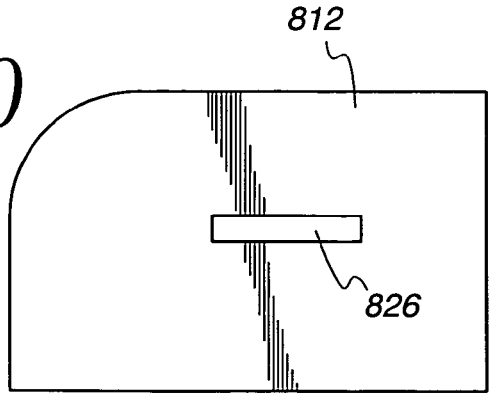
FIG. 50 is an end view of the bin-style shelf of FIG. 47.

Referring now to FIG. 47, a shipper display system is generally indicated at 800. Included is a master shell 802 similar in construction to the master shells 602 and 30, described above. Included in master shell 802 are side walls 804 having slots 806. A bin-style shelf 810 is shown mounted in master shell 802 and includes end walls 812. Referring to FIGS. 48 and 49, mounting clip 816 includes a flexible or bendable wall 818 with enlarged end portions 820. With reference to FIG. 49, clip 816 includes a mounting bracket 824 receivable in a slot 826 of end wall 812 (FIG. 50). It should be noted that the end portions 820 protrude from wall 818 in a direction opposite that of mounting clip 824. That is, with the mounting clip installed to the shelf in the manner indicated in FIG. 47, the end portions 820 protrude away from the shelf end wall 812, toward the inner surfaces of master shell side walls 804.

Preferably, mounting clip 816 is dimensioned such that the enlarged end portions 820 are spaced beyond the end wall 820 when mounted, being located above and below the upper and lower bounds of end wall 812. This allows portions of wall 818 adjacent enlarged end portions 820 to flex. Preferably, shelf 810 has lateral dimensions for a relatively close fit within master shell 802. Accordingly, the enlarged end portions 820 would interfere with the side walls 804 of master shell 802, but for the ability of the upper and lower portions of the mounting clip to bend inwardly allowing the enlarged end portions 820 to pass along the interfaces of side walls 804. This bending gives rise to a resilient bias force urging the enlarged end portions 820 toward side walls 804. With a simple front-to-back motion, the shelves are positioned within master shell 802 until the enlarged end portions 820 are received in slots 806 with a "click fit." With the enlarged end portions 820 received in slots 806, the shelves are securely retained within master shell 802. As can be seen in FIG. 47, the clips 816 can be made relatively narrow in a front-to-back direction, thus concentrating support for the shelves at the central portions of their end walls. Further, with the resilient engagement of the enlarged end portions of the mounting clip above and below the shelf, the shelf is securely retained within the master shell, against forces tending to tilt or tip the shelves.

Figure 51:
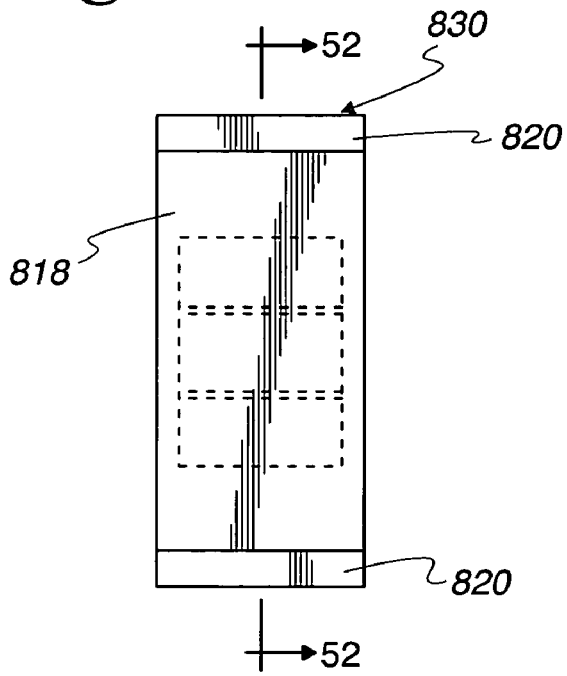
FIG. 51 is a front elevational view of an alternative mounting clip for the system of FIG. 47.
Figure 52:
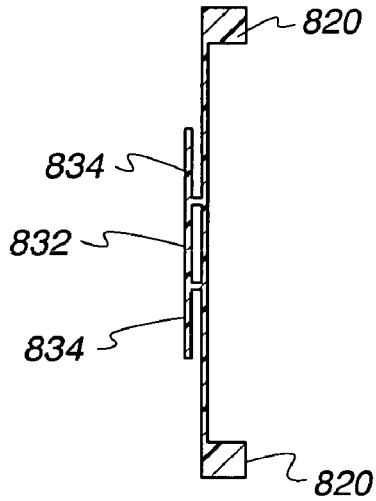
FIG. 52 is a cross-sectional view taken along the lines 52-52 of FIG. 51.
Figure 53:
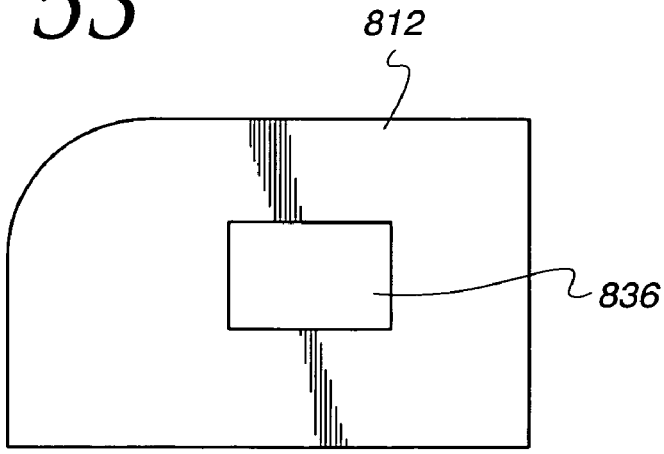
FIG. 53 is an end view of the bin-style shelf adapted for the mounting clip of FIG. 51.

Referring now to FIGS. 51-53, an alternative embodiment of the mounting clip is generally indicated at 830. Construction of clip 830 is generally identical that of clip 816 described above except for the provision for mounting the clip to the shelf end wall. As can be seen in FIG. 52, a mounting bracket 832 includes cantilever-supported flaps 834 which are receivable within opening 836 formed in the outer ply of dual-ply end wall 812 (FIG. 53). The flaps 834 are preferably made of thin resilient plastic material so as to be easily tucked within opening 836 for secure mounting to shelf end wall 812.

Figure 54:
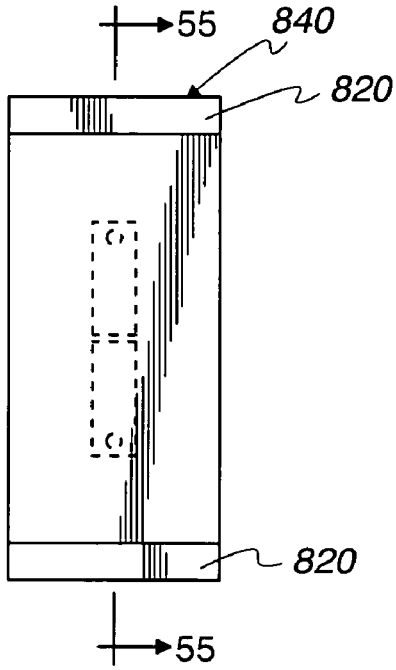
FIG. 54 is a front elevational view of a further alternative mounting clip.
Figure 55:
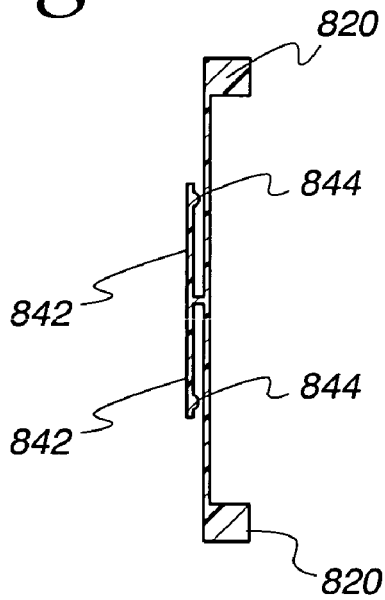
FIG. 55 is a cross-sectional view taken along the line 55-55 of FIG. 54.
Figure 56:
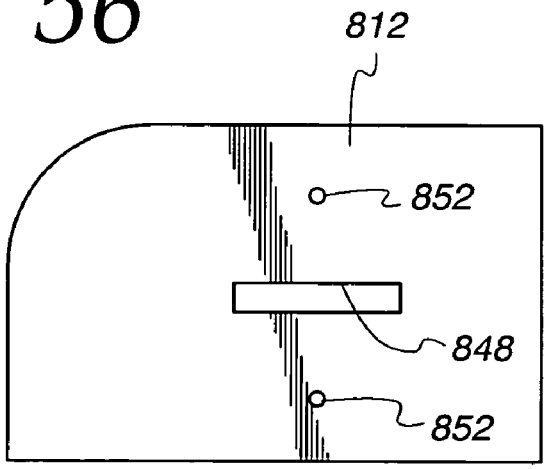
FIG. 56 is an end view of the bin-style shelf adapted for the mounting clip of FIG. 54.

Referring now to FIGS. 54-56, an alternative mounting clip is generally indicated at 840 and has features identical to the mounting clip 816 described above. With reference to FIG. 55, a pair of mounting wings 842 are provided with protrusions 844. Mounting clip 840 is rotated 90° such that the wings 842 are received in slot 848 formed in the outer ply of a dual-ply shelf end wall 812. The mounting clip is then rotated an additional 90°, in either direction, to bring protrusions 844 into engagement with apertures 852 thereby locking the mounting clip within the shelf end wall, secure against anti-rotation.

Figure 57:
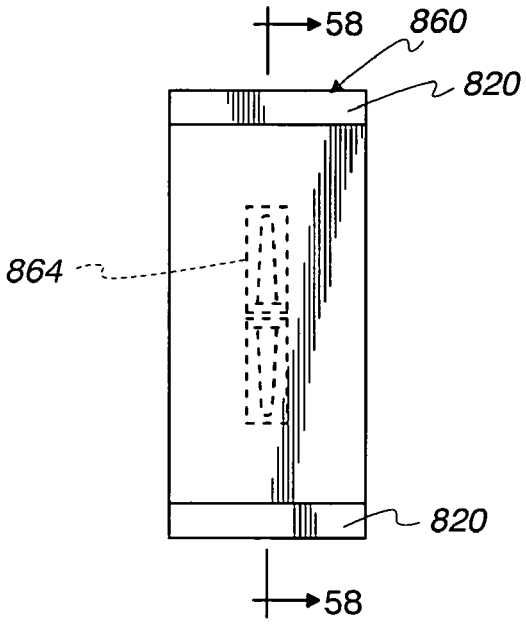
FIG. 57 is a front elevational view of another mounting clip.
Figure 58:
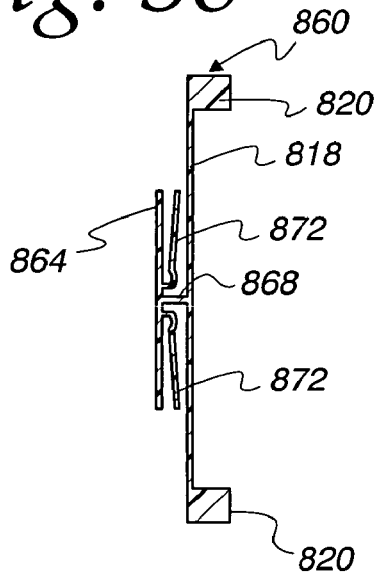
FIG. 58 is a cross-sectional view taken along the line 58-58 of FIG. 57.
Figure 59:
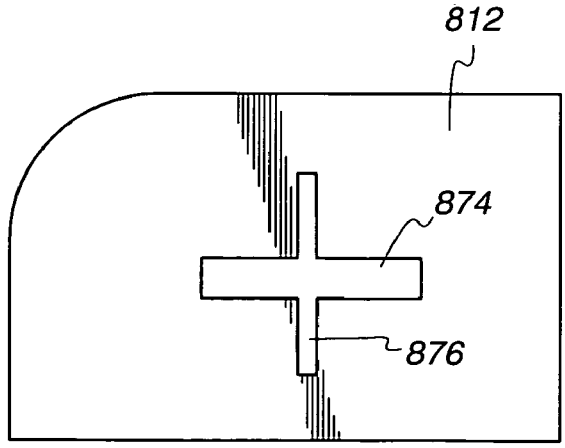
FIG. 59 is an end view of a bin-style shelf adapted for the mounting clip of FIG. 57.

Referring now to FIGS. 57-59, an alternative embodiment of the mounting clip is generally indicated at 860. The coinstruction of clip 860 is generally identical to that of clip 816 described above except for provision for twist-lock mounting of the clip to the shelf end wall. Mounting clip 860 is provided with a locking wall 864 which is spaced from clip wall 818 by a connecting portion 868. A pair of spring clips 872 extend from wall 864 adjacent connection 868 and have outer free ends extending toward enlarged end portions 820. FIG. 59 shows shelf end wall 812 with a generally horizontally extending slot 874 and a generally vertically extending slot 876. Wall 864 and the spring clips 872 of clip 860 are inserted in slot 874 and are rotated 90° to bring spring clips 872 into seating engagement with slot 876, thus locking the mounting clip against further rotation.

Figure 60:
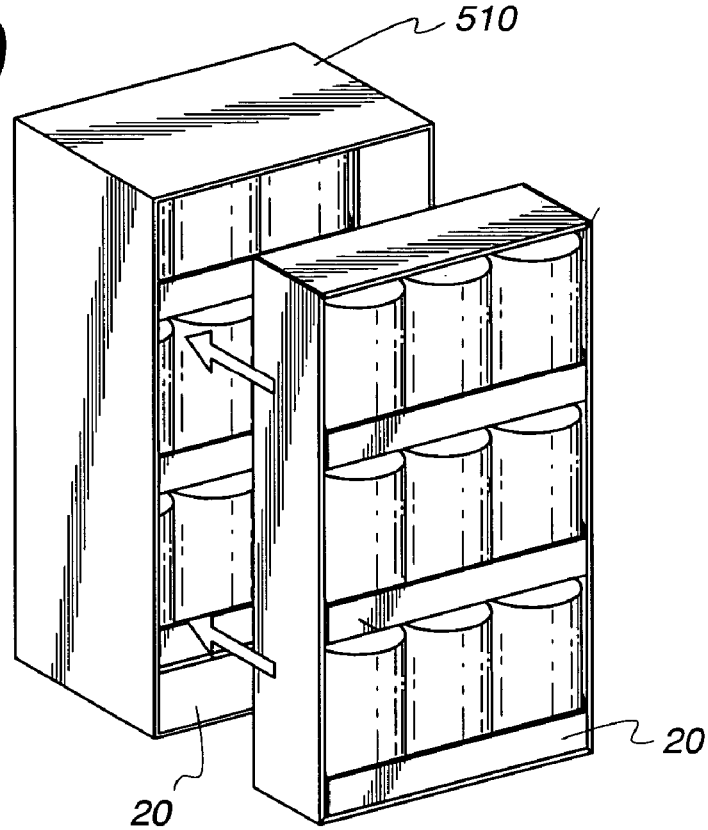
FIGS. 60-62 are perspective views of alternative adjustable shipper display systems showing different loading configurations.
Figure 61:
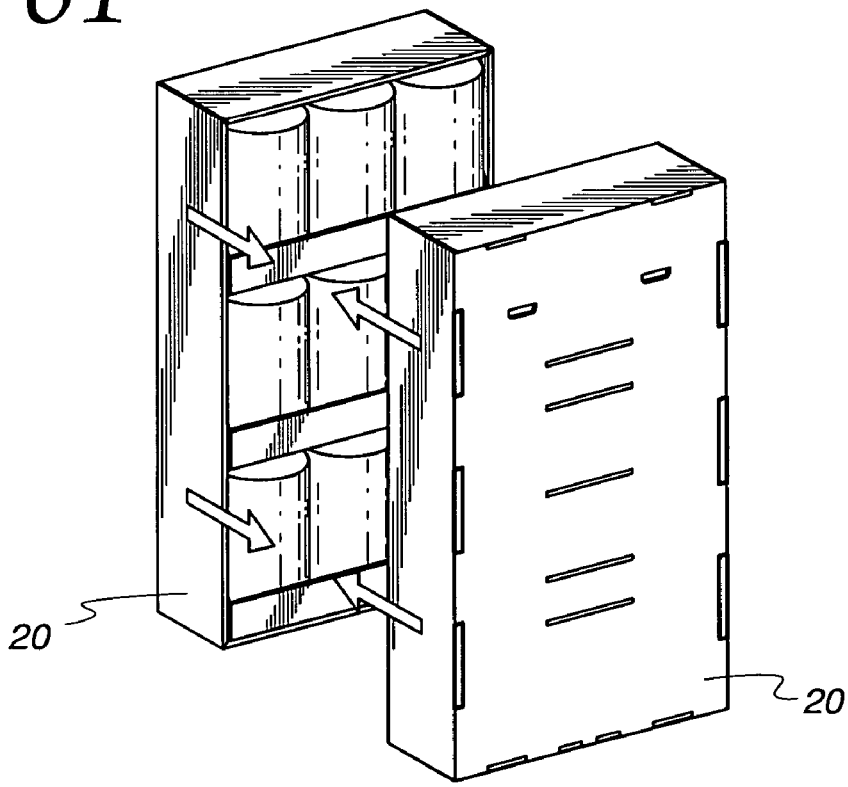
Figure 62:
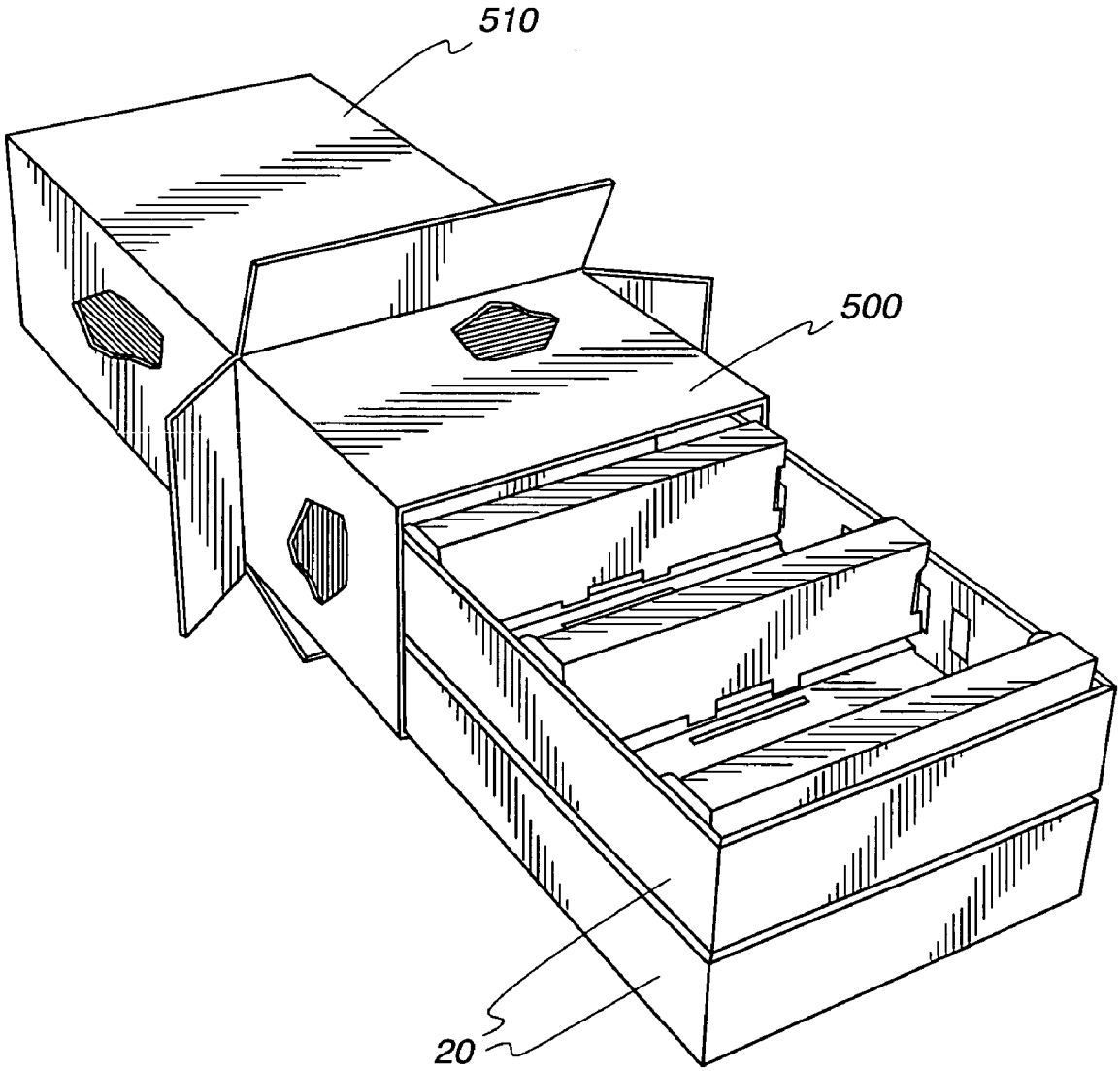

FIGS. 60-62 show various arrangements of shipper display systems made ready for palletized loading, are shown. In FIG. 60, a pair of shipper display systems 20 are arranged front-to-back for vertical loading in an outer shipper carton 510. In FIG. 61, the shipper display systems 20 are arranged front-to-front, again for vertical loading within an outer carton 510, in the manner indicated in FIG. 60. In FIG. 62, a pair of shipper display systems 20 are arranged front-to-back and are laid on their backs for horizontal loading within an outer shipper carton 510. A sleeve 500 is inserted within outer carton 510 to provide added support therefor. As indicated in FIG. 62, the directions of corregation of sleeve 500 and outer carton 510 are displaced at angles from one another, preferably 90°, to further increase the support given to outer carton 510 by sleeve 500.

Figure 63:
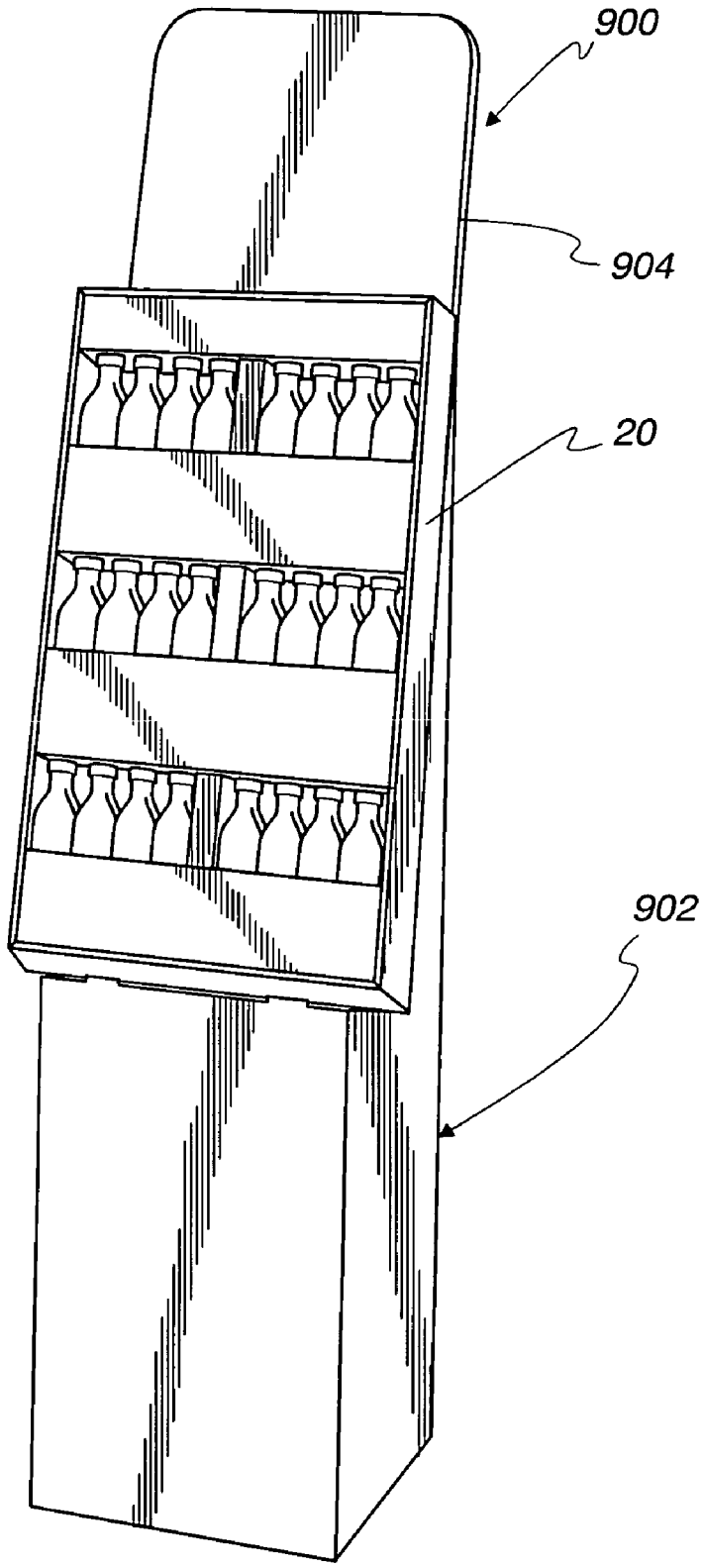
FIG. 63 is a perspective view of a display arrangement incorporating adjustable shipper display systems according to principles of the present invention.
Figure 64:
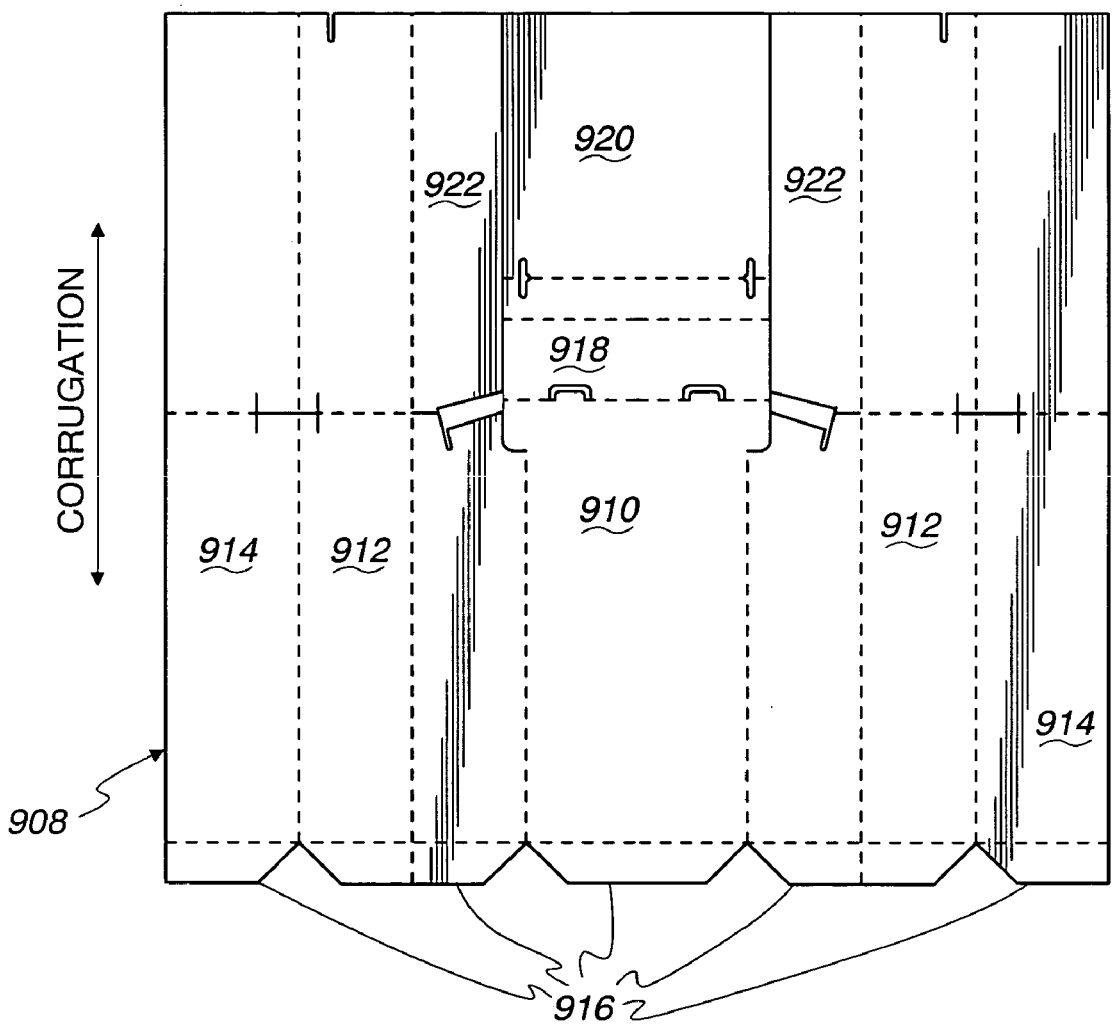
FIG. 64 is top plan view of a blank for the display base therefor.
Figure 65:
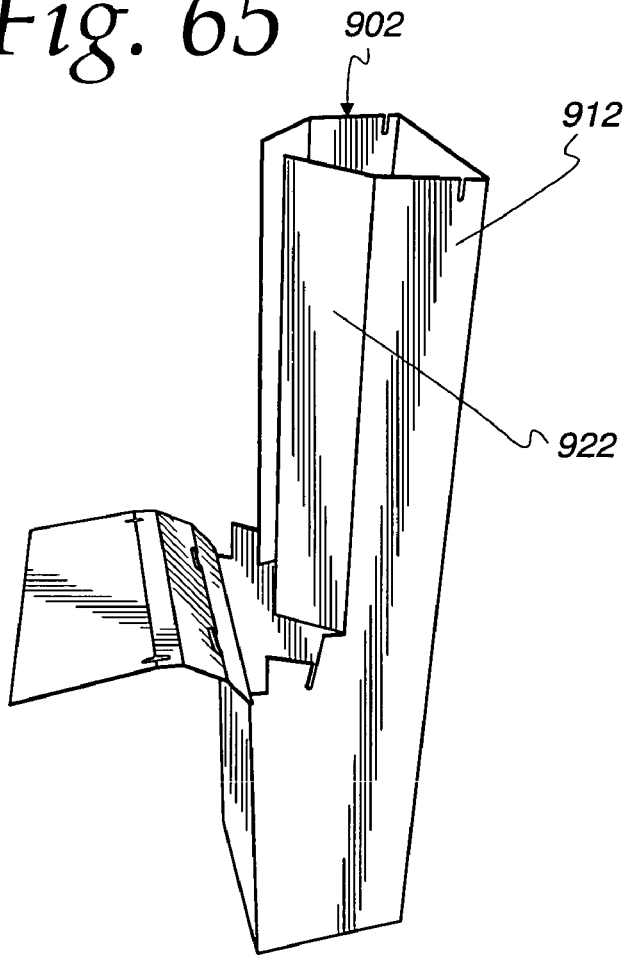
FIGS. 65-68 are fragmentary perspective views showing erection of a display base.
Figure 66:
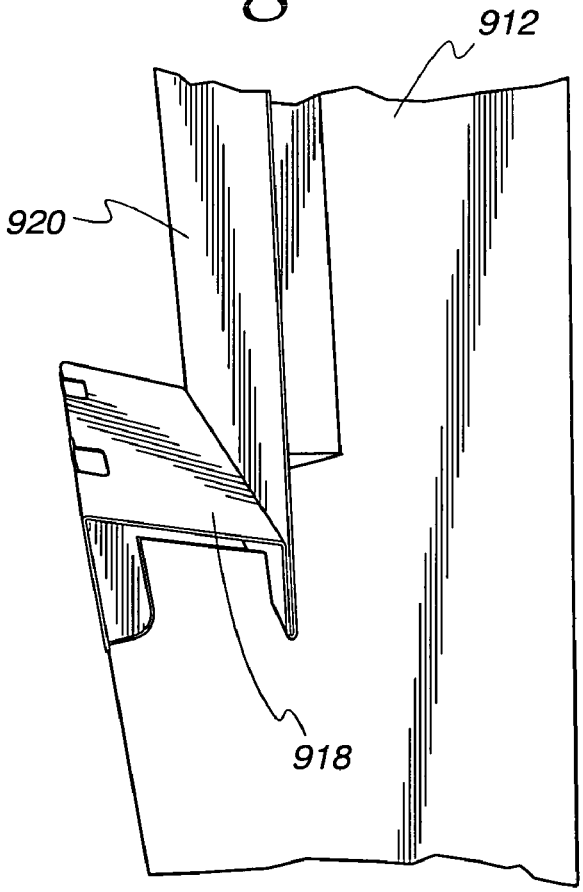
Figure 67:
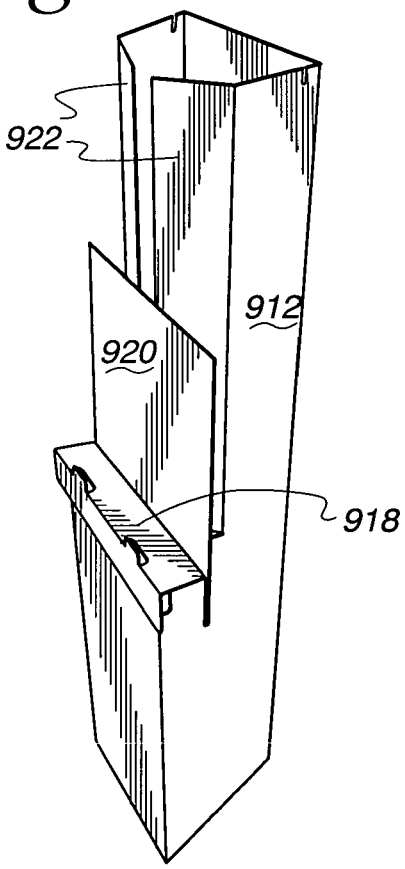
Figure 68:
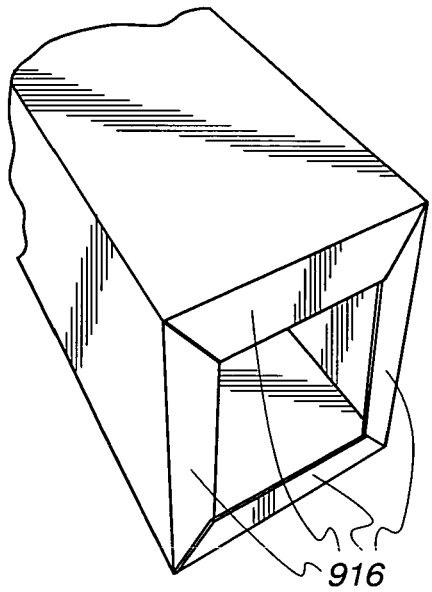

Turning now to FIGS. 63-71, and initially to FIG. 63, a display system is generally indicated at 900. Included in display system 900 is a display base generally indicated at 902, a shipper display system 20 mounted atop the display base and a header card 904. FIG. 64 shows a blank, preferably of corrugated paperboard material, from which display base 902 is formed. Included in blank 908 is a front wall 910 extending the full height of the display base. The side walls 912 are located on either side of front wall 910. Back wall portions 914 are located at either side of blank 908. When folded in the manner indicated in FIGS. 66 and 67, bottom flaps 916 are folded over as indicated in FIG. 68 to form a base wall for upright support of the display base. Front wall 910 is folded at its stepped panel portions 918, 920 to form a step configuration as shown in FIGS. 66, 67. The upper portions of side walls 912 are folded to bring panel portions 922 to lie parallel to front wall 910 so as to provided underlying backing support for step wall 920, as can be seen in FIG. 67.

Figure 69:
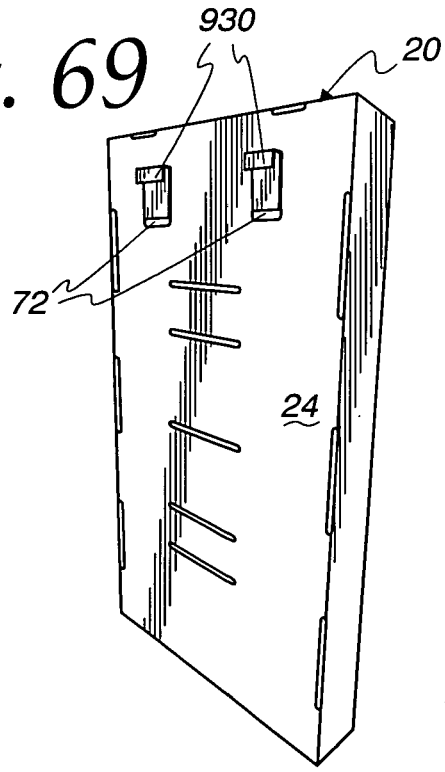
FIG. 69 is a perspective view of a shipper display system being readied for installation on the display base.
Figure 70:
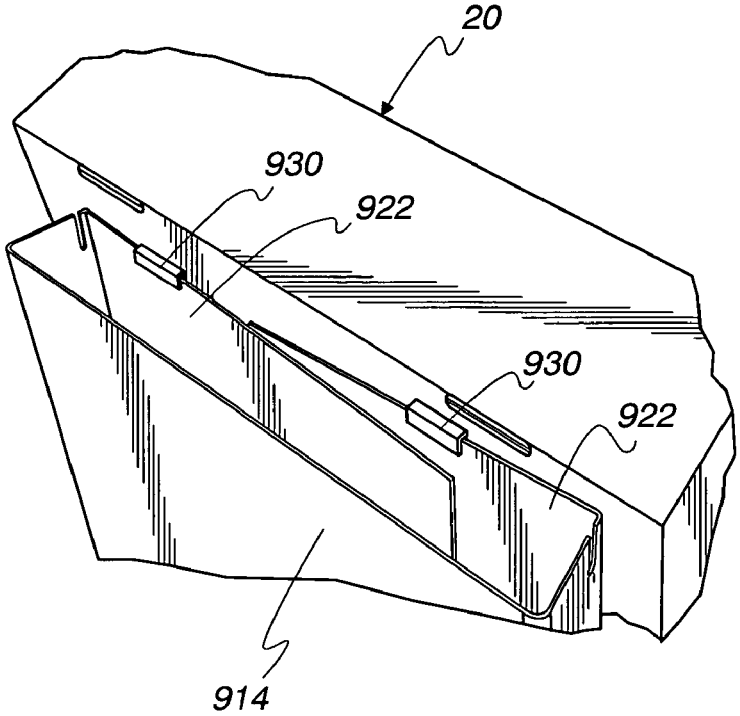
FIGS. 70-71 show mounting of the shipper display system on the display base.
Figure 71:
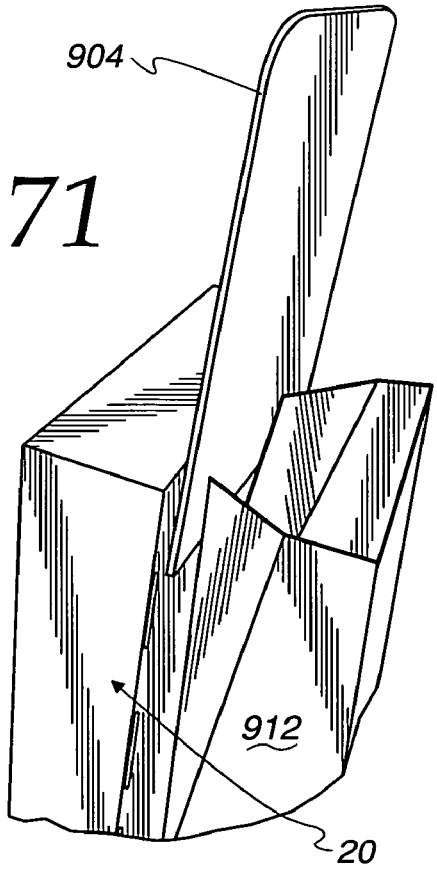

Referring to FIG. 69, the rear wall 24 of shipper display system 20 contains mounting slots 72 as described above with reference to FIG. 17. In the arrangement shown in FIG. 69, mounting clips 930 are installed to provide a hook connection to mounting base 902 in the manner indicated in FIG. 70. As shown in FIG. 70, mounting clips 930 are hooked to front support panels 922 while the bottom portion of the shipper display system is nested within the step formed by walls 918, 920. As indicated in FIG. 66, it is generally preferred that walls 918, 920 cooperate to provide an inclined support for the upright or vertically oriented shipper display system in order to provide support against tipping or other dislodgement of the shipper display system from the display base. In FIG. 71, an optional header card 904 is inserted atop the display base at a point adjacent shipper display 20.

The drawings and the foregoing descriptions are not intended to represent the only forms of the invention in regard to the details of its construction and manner of operation. Changes in form and in the proportion of parts, as well as the substitution of equivalents, are contemplated as circumstances may suggest or render expedient; and although specific terms have been employed, they are intended in a generic and descriptive sense only and not for the purposes of limitation, the scope of the invention being delineated by the following claims.

The invention claimed is:

1. An adjustable package system for shipping and displaying a plurality of articles, comprising:

a master shell having a back and a pair of sidewalls extending from the back to form a master shell volume;

said sidewalls including a plurality of mounting positions, arranged in a preselected number of horizontally opposed pairs;

a plurality of shelves extending between ones of said pairs of mounting positions;

shelf mounts extending between said shelves and said mounting positions so that said shelves receive support from said sidewalls; and said shelf mounts having at least one pair of spaced apart clip walls for receiving a sidewall of the shelves and an adjacent sidewall of the master shell therebetween.

2. The adjustable package system of claim 1 wherein the number of shelves is less than the number of pairs of mounting positions.

3. The adjustable package system of claim 1 wherein the shelf mounts comprise rigid clips having a first portion for clip engagement with said sidewalls and a tab portion for engaging ends of said shelves.

4. The adjustable package system of claim 1 wherein said back defines a plurality of slots and said shelves include rearwardly facing tabs at least partially received in said slots.

5. The adjustable package system of claim 1 wherein said master shell is formed from a single integral blank which is scored and folded.

6. The adjustable package system of claim 1 wherein the plurality of shelves includes at least one bin-style shelf having a floor and a continuous closed sidewall extending from the floor.

7. The adjustable package system of claim 6 wherein said at least one bin-style shelf is formed from a single integral blank which is scored and folded.

8. The adjustable package system of claim 1 wherein the plurality of shelves includes at least one open front shelf having a floor and sidewalls extending from the floor forming an opening.

9. The adjustable package system of claim 8 wherein said at least one open front shelf is formed from a single integral blank which is scored and folded.

10. The adjustable package system of claim 1 wherein the plurality of shelves includes at least one double tier shelf having two vertically spaced apart floors with sidewalls extending from the floors forming an opening.

11. The adjustable package system of claim 10 wherein said at least one double tier shelf is formed from two integral blanks which are scored and folded.

12. The adjustable package system of claim 1 wherein said shelves define storage spaces, said system further comprising at least one filler in one of said shelves dividing the storage space of said shelf.

13. The adjustable package system of claim 1 wherein said shelf mounts have a tab portion that extends into a opening of a respective shelf.

14. An adjustable package system for shipping and displaying a plurality of articles, comprising:

a master shell having a back and a pair of sidewalls extending from the back to form a master shell volume;

said sidewalls including a plurality of mounting positions, arranged in a preselected number of horizontally opposed pairs;

a plurality of shelves extending between ones of said pairs of mounting positions;

shelf mounts extending between said shelves and said mounting positions so that said shelves receive support from said sidewalls; and said shelves include opposed ends which define openings for receiving a tab portion.

15. An adjustable package system for shipping and displaying a plurality of articles, comprising:

a master shell having a back and a pair of sidewalls extending from the back to form a master shell volume;

said sidewalls including a plurality of mounting positions, arranged in a preselected number of horizontally opposed pairs;

a plurality of shelves extending between ones of said pairs of mounting positions; and shelf mounts extending between said shelves and said mounting positions so that said shelves receive support from said sidewalls;

said shelves define storage spaces, said system further comprising at least one filler in one of said shelves dividing the storage space of said shelf; and said at least one filler is formed from a single integral blank which is scored and folded.

16. An adjustable package system for shipping and displaying a plurality of articles, comprising:

a master shell having a back and a pair of sidewalls extending from the back to form a master shell volume;

said sidewalls including a plurality of mounting positions, arranged in a preselected number of horizontally opposed pairs;

a plurality of shelves extending between ones of said pairs of mounting positions;

shelf mounts extending between said shelves and said mounting positions so that said shelves receive support from said sidewalls; and said shelves include a pair of opposed end walls, said shelf mounts comprise clips having a pair of clip walls for receiving a portion of said master shell sidewalls and a tab portion defining a slot for receiving an end wall of said shelves.

17. A blank for forming an open front shelf of an adjustable package system for shipping and display a plurality of articles, comprising a single integral unitary body of foldable material divided into three column positions including:

a central column position comprising a serial succession of a rear wall portion, an outer floor portion and an inner floor portion; and outer column positions comprising a serial succession of a side wall portion foldably joined to said rear wall portion and an intermediate floor portion foldably joined to the side wall portion so as to be trapped between said outer and said inner floor portions when the blank is erected to form an open front shelf.

18. An adjustable package system for shipping and displaying a plurality of articles, comprising:

a master shell having a back and a pair of sidewalls extending from the back to form a master shell volume;

said sidewalls including a plurality of mounting positions, arranged in a preselected number of horizontally opposed pairs;

a plurality of shelves extending between ones of said pairs of mounting positions;

shelf mounts extending between said shelves and said mounting positions so that said shelves are slidingly inserted in said master shell so as to receive support from said sidewalls; and said shelves include end walls located on either side of a rear wall defining an opening and the shelf mounts comprise rigid clips having a first portion for clip engagement with said sidewalls and a socket portion received in said opening for partly engaging portions of said end walls.

19. An adjustable package system for shipping and displaying a plurality of articles, comprising:

a master shell having a back and a pair of sidewalls extending from the back to form a master shell volume;

said sidewalls including a plurality of mounting positions, arranged in a preselected number of horizontally opposed pairs;

a plurality of shelves extending between ones of said pairs of mounting positions;

shelf mounts extending between said shelves and said mounting positions so that said shelves are slidingly inserted in said master shell in an orientation perpendicular to the back of the master shell so as to receive support from said sidewalls; and wherein the plurality of shelves includes at least one open front shelf having a floor and sidewalls extending from the floor forming an opening.

20. An adjustable package system for shipping and displaying a plurality of articles, comprising:

a master shell having a back and a pair of sidewalls extending from the back to form a master shell volume;

said sidewalls including a plurality of mounting positions, arranged in a preselected number of horizontally opposed pairs;

a plurality of shelves extending between ones of said pairs of mounting positions;

shelf mounts extending between said shelves and said mounting positions so that said shelves are slidingly inserted in said master shell so as to receive support from said sidewalls;

said shelves define storage spaces; and said system further comprising at least one filler in one of said shelves dividing the storage space of said shelf, said at least one filler formed from a single integral blank which is scored and folded.

21. An adjustable package system for shipping and displaying a plurality of articles, comprising:

a master shell having a back and a pair of sidewalls extending from the back to form a master shell volume;

said sidewalls including a plurality of mounting positions, arranged in a preselected number of horizontally opposed pairs with said sidewalls defining recesses at said mounting positions;

a plurality of shelves extending between ones of said pairs of mounting positions said shelves having opposed end walls adjacent said sidewalls; and shelf mounts carried on said end walls, including mounting lugs received in said recesses so that said shelves receive support from said sidewalls.

22. The adjustable package system of claim 21 wherein the number of shelves is less than the number of pairs of mounting positions.

23. The adjustable package system of claim 21 wherein the shelf mounts comprise a flexible base carrying said mounting lugs and providing a resilient engaging force, urging said mounting lugs toward said recesses.

24. The adjustable package system of claim 23 further comprising a twist lock mount carried on said flexible base and said end walls include a recess for engaging said twist lock mount.

25. The adjustable package system of claim 23 further comprising a mounting protrusion carried on said flexible base and said end walls include a recess for engaging said mounting protrusion.

26. The adjustable package system of claim 21 wherein the plurality of shelves includes at least one bin-style shelf having a floor and a continuous closed sidewall extending from the floor.

27. The adjustable package system of claim 21 wherein the plurality of shelves includes at least one open front shelf having a floor and sidewalls extending from the floor forming an opening.

28. The adjustable package system of claim 21 wherein the plurality of shelves includes at least one double tier shelf having two vertically spaced apart floors with sidewalls extending from the floors forming an opening.

29. The adjustable package system of claim 21 wherein said shelves define storage spaces, said system further comprising at least one filler in one of said shelves dividing the storage space of said shelf.

30. A display base for the upright display of an adjustable package system having a back wall, side walls, and an open front, formed from an integral blank having a serial succession of wall panels including a front panel having upper and lower portions, the upper portion scored to form step walls folded to form a C-shaped profile with a bottom portion;

side wall panels on either side of said front wall panel, said side wall panels provided into upper and lower portions with the upper portions divided into side-by-side panel parts;

rear wall panels on either side of said side wall panels;

said front wall panel, said side wall panels and said panel parts including fold lines; and said blank foldable about said fold lines so that side wall panels are folded generally at 90" to said front wall panel and said rear wall panels are foldable generally at 90" to said side wall panel, with one of said side-by-side panel parts foldable so as to lie generally parallel to said front wall panel in contact with at least a part of the upper portion of said front wall panel when folded so as to form said generally C-shaped profile.

* * * * *

UNITED STATES PATENT AND TRADEMARK OFFICE

CERTIFICATE OF CORRECTION

PATENT NO. : 7,374,047 B2
APPLICATION NO. : 10/887658
DATED : May 20, 2008
INVENTOR(S) : Michelle Marie Bryson et al.

It is certified that error appears in the above-identified patent and that said Letters Patent is hereby corrected as shown below:

Column 14, lines 47-48, delete “a opening” and insert --an opening-- therefor.
Column 15, line 5, delete “and”.
Column 18, line 10, delete “90"” and insert --90°-- therefor.
Column 18, line 12, delete “90"” and insert --90°-- therefor.

Signed and Sealed this

Second Day of September, 2008

JON W. DUDAS
*Director of the United States Patent and Trademark Office*